US011789394B2

(12) United States Patent
Mutsuno

(10) Patent No.: US 11,789,394 B2
(45) Date of Patent: Oct. 17, 2023

(54) PRINT SYSTEM, PRINTING APPARATUS, INFORMATION PROCESSING APPARATUS, METHOD OF CONTROLLING THE SAME, AND STORAGE MEDIUM

(71) Applicant: CANON KABUSHIKI KAISHA, Tokyo (JP)

(72) Inventor: Masahiro Mutsuno, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/736,466

(22) Filed: May 4, 2022

(65) Prior Publication Data

US 2022/0373955 A1 Nov. 24, 2022

(30) Foreign Application Priority Data

May 20, 2021 (JP) ..... 2021-085580

(51) Int. Cl.
*G03G 15/00* (2006.01)

(52) U.S. Cl.
CPC ..... *G03G 15/5062* (2013.01); *G03G 2215/00569* (2013.01)

(58) Field of Classification Search
CPC ..... G03G 15/5062
See application file for complete search history.

(56) References Cited

U.S. PATENT DOCUMENTS

2013/0216244 A1* 8/2013 Miyazaki ..... G03G 15/5062 399/15
2019/0155188 A1* 5/2019 Shimomura ..... G03G 15/5058
2019/0166273 A1* 5/2019 Komazawa ..... G06F 3/1256

FOREIGN PATENT DOCUMENTS

JP 2002019236 A * 1/2002
JP 2010122377 A 6/2010

* cited by examiner

*Primary Examiner* — Carla J Therrien
(74) *Attorney, Agent, or Firm* — ROSSI, KIMMS & McDOWELL LLP

(57) ABSTRACT

A print system having an information processing apparatus and a printing apparatus configured to receive a print job from the information processing apparatus and execute printing. The information processing apparatus sets so as to insert a chart sheet on which patches for tone correction have been printed for the print job. In a case where the print job includes a setting to insert the chart sheet, the printing apparatus controls whether or not to insert the chart sheet based on a type of sheet to be used in the print job.

17 Claims, 18 Drawing Sheets

FIG. 9A

881

| REFERENCE INFORMATION | | | | | | | | | | |
|---|---|---|---|---|---|---|---|---|---|---|
| DEN-SITY | 100 | 90 | 80 | 70 | 60 | 50 | 40 | 30 | 20 | 10 |
| C | 1022 | 922 | 819 | 717 | 617 | 512 | 405 | 307 | 205 | 102 |
| M | 1020 | 923 | 820 | 717 | 615 | 513 | 412 | 309 | 210 | 103 |
| Y | 1016 | 921 | 819 | 717 | 614 | 512 | 410 | 305 | 205 | 99 |
| K | 1023 | 920 | 820 | 713 | 611 | 510 | 408 | 307 | 207 | 100 |

882

| MEASUREMENT VALUES | | | | | | | | | | |
|---|---|---|---|---|---|---|---|---|---|---|
| DEN-SITY | 100 | 90 | 80 | 70 | 60 | 50 | 40 | 30 | 20 | 10 |
| C | 1018 | 921 | 822 | 719 | 620 | 520 | 401 | 307 | 203 | 100 |
| M | 1010 | 920 | 815 | 723 | 615 | 523 | 422 | 311 | 214 | 100 |
| Y | 1005 | 923 | 824 | 710 | 619 | 512 | 411 | 309 | 207 | 110 |
| K | 1020 | 915 | 815 | 700 | 601 | 512 | 405 | 302 | 205 | 95 |

883

| CORRECTION INFORMATION | | | | | | | | | | |
|---|---|---|---|---|---|---|---|---|---|---|
| DEN-SITY | 100 | 90 | 80 | 70 | 60 | 50 | 40 | 30 | 20 | 10 |
| C | 4 | 1 | −3 | −2 | −3 | −8 | 4 | 0 | 2 | 2 |
| M | 10 | 3 | 5 | −6 | 0 | −10 | −10 | −2 | −4 | 3 |
| Y | 11 | −2 | −5 | 7 | −5 | 0 | −1 | −4 | −2 | −11 |
| K | 3 | 5 | 5 | 13 | 10 | −2 | 3 | 5 | 2 | 5 |

FIG. 9B

| 891 | 892 | 893 | 894 | 895 | 896 |
|---|---|---|---|---|---|
| TYPE OF SHEET | TARGET SHEET FEEDER | REFERENCE INFORMATION (1/2 SPEED) | REFERENCE INFORMATION (1/1 SPEED) | GENERATED PAGES | Timestamp |
| PLAIN PAPER 3 | CST1 | NULL | YES TBL 881 | 60014 | 2019/07/18 10:04:06 |
| COATED PAPER 1 | CST4 | NULL | NULL | NULL | NULL |
| | | | | | |
| | | | | | |

FIG. 9C

| | 897 | 898 | 899 | | |
|---|---|---|---|---|---|
| TYPE OF SHEET | TARGET SHEET FEEDER | CORRECTION INFORMATION (1/2 SPEED) | CORRECTION INFORMATION (1/1 SPEED) | GENERATED PAGES | Timestamp |
| PLAIN PAPER 3 | CST1 | NULL | YES TBL 883 | 640015 | 2019/07/18 18:34:21 |
| COATED PAPER 1 | CST4 | NULL | NULL | NULL | NULL |
| | | | | | |
| | | | | | |

PRINT SYSTEM, PRINTING APPARATUS, INFORMATION PROCESSING APPARATUS, METHOD OF CONTROLLING THE SAME, AND STORAGE MEDIUM

BACKGROUND OF THE INVENTION

Field of the Invention

The present invention relates to a print system, a printing apparatus, an information processing apparatus, a method of controlling the same, and a storage medium.

Description of the Related Art

A print system in which an inline sensor is connected downstream in a printing apparatus for forming an image on a sheet and the image on the sheet formed by the printing apparatus is read by the inline sensor is known. In such a print system, the printing apparatus outputs a print product on which patches have been printed in a space of the print product to adjust an image forming position and image quality. Then, the patches are read by the inline sensor, and based on the result, the image forming position and image quality of printing by the printing apparatus are adjusted. Then, by the inline sensor reading the patches printed by the adjusted printing apparatus, the adjustment result can be fed back to the printing apparatus in real time.

However, depending on the print data, there may be no space for printing patches on a print product. In that case, by performing an adjustment by inserting, at fixed intervals during the execution of a print job, a sheet on which only the patches have been printed (hereinafter, referred to as "interrupt adjustment"), the image forming position and image quality of the entire print product can be kept constant.

Japanese Patent Laid-Open No. 2010-122377 accepts, from a user, settings for a sheet feeder and a concentration variation range that is allowed for output products to be printed from the sheet feeder. It proposes a method in which the printing apparatus outputs a test sheet at a timing (prescribed number of printed sheets) based on the allowable density variation range according to the setting by the user.

In the above-described prior art, the user can have the sheet feeder used in the interrupt adjustment job be the same as the sheet feeder used in a print job. However, if a sheet that has a specific position in a sequence (a sheet whose position in a sequence matters), such as a tab position of tab dividers, is consumed by the interrupt adjustment job, the order of sheets will be different after resumption. In such a case, the result of output for which the interrupt adjustment has been executed becomes different from what was originally intended, generating a defect. To avoid such a defect, it is necessary for the user to determine in advance whether or not to instruct the interrupt adjustment depending on whether or not a sheet feeder can be used for the interrupt adjustment job, which is not easy to set.

SUMMARY OF THE INVENTION

An aspect of the present invention is to eliminate the above-mentioned problem with conventional technology.

A feature of the present invention is to provide a technique that makes it possible to prevent a result that is different from a result that has been intended by a user from being obtained by the interrupt adjustment.

According to a first aspect of the present invention, there is provided a print system having an information processing apparatus and a printing apparatus configured to receive a print job from the information processing apparatus and execute printing, the information processing apparatus comprising: one or more first processors and one or more first memories being configured to: for the print job, set so as to insert a chart sheet on which patches for tone correction have been printed, and the printing apparatus comprising: a printer unit; and one or more second processors and one or more second memories being configured to: in a case where the print job includes a setting to insert the chart sheet, control whether or not to insert the chart sheet based on a type of sheet to be used in the print job.

According to a second aspect of the present invention, there is provided a printing apparatus having a printer unit and a colorimeter, the apparatus comprising: one or more processors and one or more memories being configured to: perform colorimetry, using the colorimeter, on a chart sheet on which patches for tone correction have been printed in a case where a print job includes a setting to insert the chart sheet, control whether or not to insert the chart sheet based on a type of sheet to be used in the print job.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 9A is a diagram illustrating an example of reference information, measurement values, and correction information generated based on CMYK density information scanned by color sensors.

FIG. 9B is a diagram illustrating an example of a table in which a reference information storage module manages the reference information.

FIG. 9C is a diagram illustrating an example of a table in which a correction information storage module manages the correction information.

DESCRIPTION OF THE EMBODIMENTS

Embodiments of the present invention will be described hereinafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention.

Figure 1:
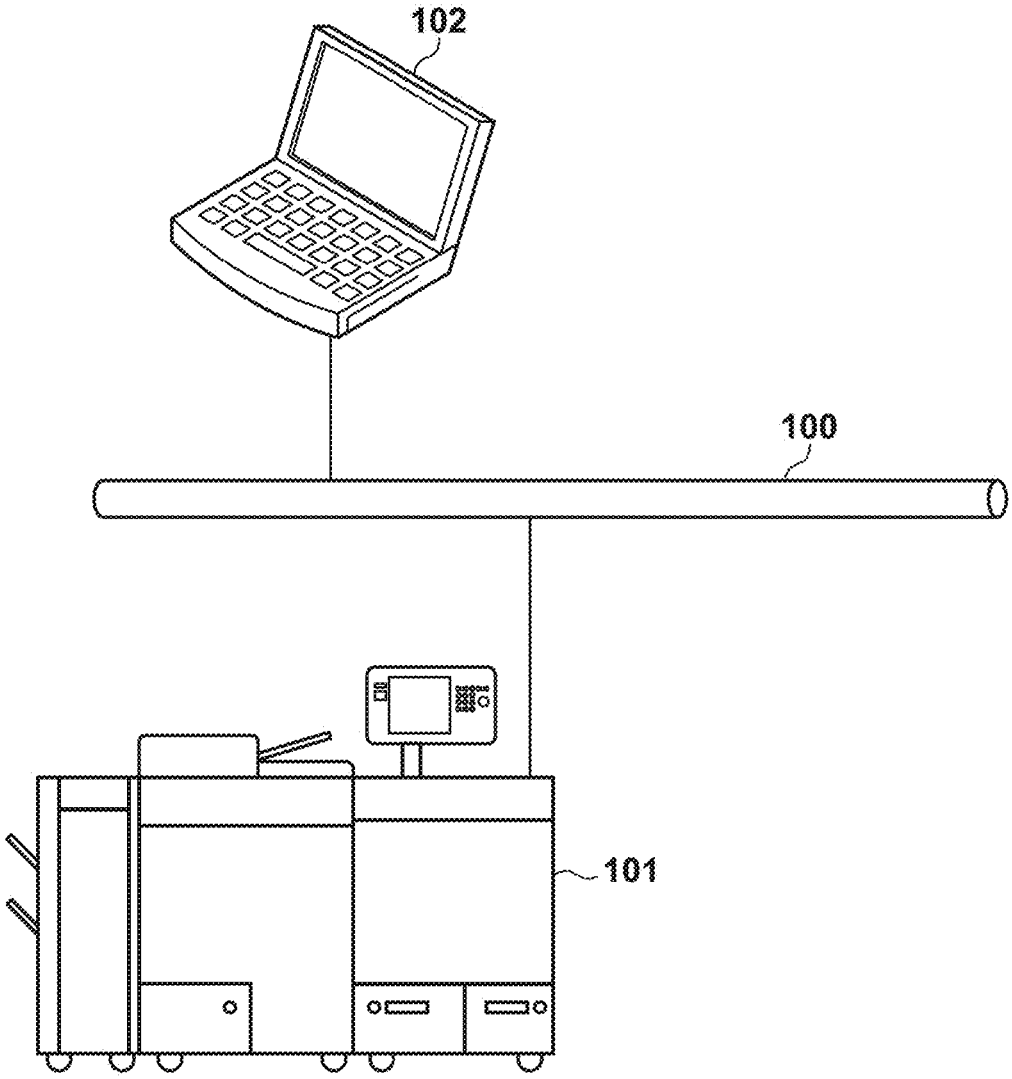
FIG. 1 is a diagram for explaining a configuration of a print system according to an embodiment of the present invention.

FIG. 1 is a diagram for explaining a configuration of a print system according to an embodiment of the present invention.

In this print system, an information processing apparatus 102 and a printing apparatus 101 are connected by a LAN 100 (network). The printing apparatus 101 can print according to a print job received from the information processing apparatus 102.

In the embodiment, the above-described configuration example will be described as an example of a print system, but the present invention is not limited to this, and it need only be that at least one information processing apparatus and a printing apparatus are connected to be capable of communicating via a network. In addition, the network may be wireless or wired.

Figure 2:
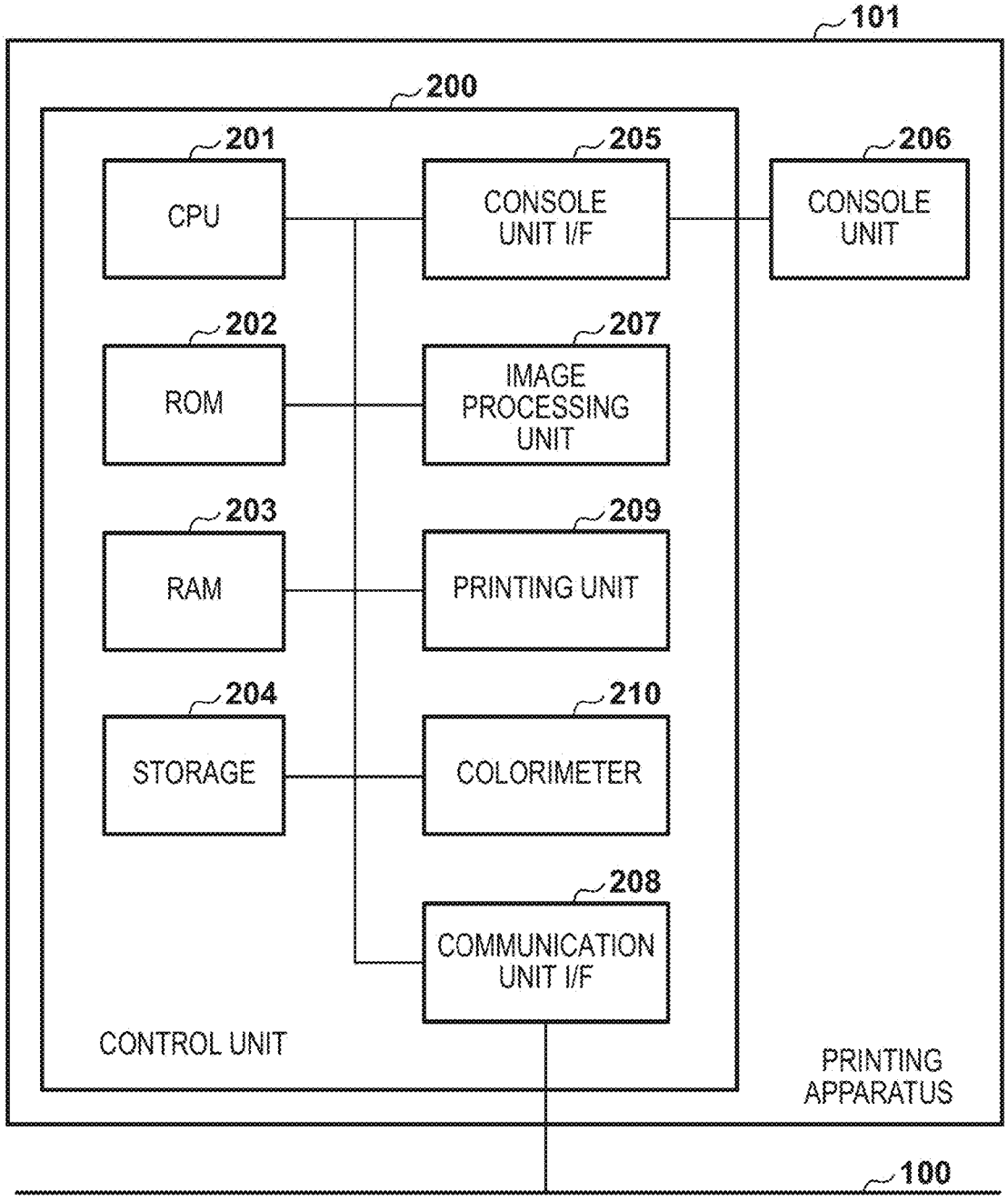
FIG. 2 is a block diagram for explaining a hardware configuration of a printing apparatus according to the embodiment.

FIG. 2 is a block diagram for explaining a hardware configuration of the printing apparatus 101 according to the embodiment. The printing apparatus 101 has a function of printing an image on a sheet. In the embodiment, a printing apparatus having only a printing function will be described as an example, but the printing apparatus may be an MFP (Multi Function Peripheral) or the like including a scanner or FAX function in the printing apparatus.

A control unit 200 including a CPU (Central Processing Unit) 201 controls the operation of the entire printing apparatus 101. The CPU 201 deploys a program stored in a ROM (Read Only Memory) 202 or a storage 204 into a RAM 203 and executes the deployed program to perform various kinds of control such as print control and read control. The ROM 202 stores a control program, a boot program, and the like, which can be executed by the CPU 201. The RAM (Random Access Memory) 203 is a main memory of the CPU 201 and is used as a work area of the CPU 201 and a temporary storage region for deploying various control programs. The storage 204 stores print data, image data, various programs, and various kinds of setting information. In the embodiment, an auxiliary storage device such as an HDD (hard disk drive) is assumed as the storage 204, but a non-volatile memory such as an SSD (Solid State Drive) may be used. In the printing apparatus 101 according to the embodiment, it is assumed that one CPU 201 uses one memory (RAM 203) to execute each of the processes indicated in the flowcharts to be described later, but another mode may be taken. For example, each of the processes indicated in the flowcharts to be described later may be executed by cooperation of a plurality of CPUs, RAMs, ROMs, and storage. Configuration may be taken so as to execute part of the processes using a hardware circuit such as an ASIC (Application Specific Integrated Circuit) or an FPGA (Field-Programmable Gate Array).

A console unit interface (I/F) 205 connects a console unit 206 and the control unit 200. The console unit 206 is provided with a display unit having a touch panel function, various hard keys and the like, and functions as a display output unit for displaying information and a reception unit for receiving an instruction of a user. An image processing unit 207 has a function of an RIP (Raster Image Processor) that generates image data used for printing by rasterizing a print job received via a communication unit I/F 208. The image processing unit 207 may also perform resolution conversion or correction processing of image data obtained by rasterizing a print job. In the present embodiment, it is assumed that the image processing unit 207 is realized by a hardware circuit (such as an ASIC or an FPGA), but the present invention is not limited to this. For example, the printing apparatus 101 may further include a processor for image processing, and image processing and processing for rasterizing into print data may be realized by the processor executing an image processing program. In this case, it is assumed that the flowcharts to be described later are realized by cooperation of the processor and the CPU 201. Further, configuration may be taken so as to perform image processing and rasterization processing of print data by the CPU 201 executing a program for performing image processing. Further, image processing may be performed by any combination of these.

A printer unit (printer engine) 209 prints an image on a sheet fed from a sheet feeding cassette (not illustrated) based on the image data generated by the image processing unit 207. The method of printing for the printer unit 209 may be an electro-photographical method or an inkjet method. Another printing method may also be adopted, such as a thermal transfer method.

A colorimeter 210 is positioned downstream of a sheet conveyance path of the printer unit 209 and obtains colorimetric data by measuring, with color sensors, which are CISs (Contact Image Sensors), the colors of tone patches of each color of marks for tone correction formed on the printed sheet.

The control unit 200 is connected to the LAN 100 via the communication unit I/F 208. The communication unit I/F 208 receives a print request (print job) from the information processing apparatus 102 on the LAN 100.

Figure 3:
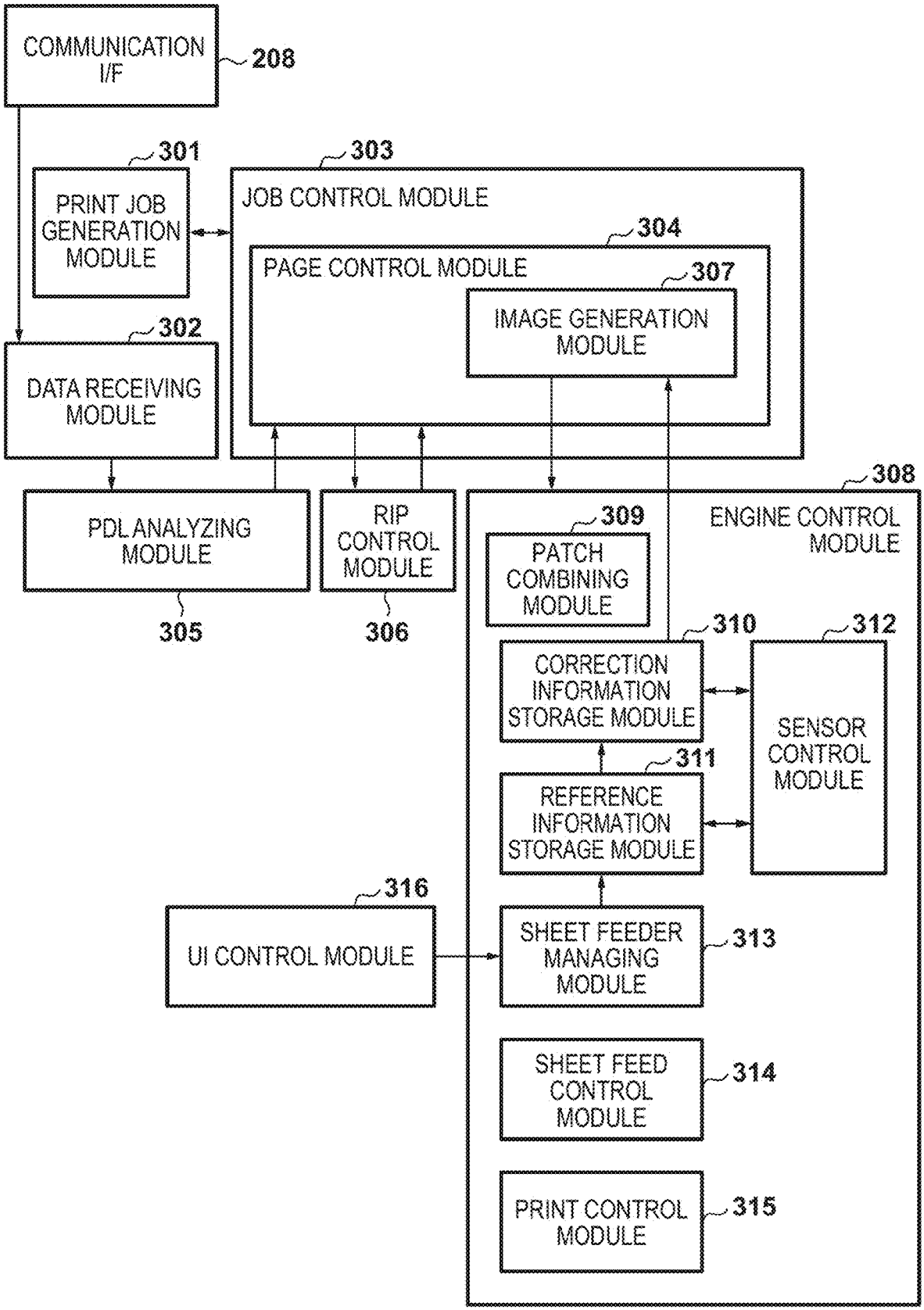
FIG. 3 is a functional block diagram for explaining a software configuration of the printing apparatus according to the embodiment.

FIG. 3 is a functional block diagram for explaining a software configuration of the printing apparatus 101 according to the embodiment.

When a job is inputted, a print job generation module 301 generates a print job and registers the print job in a job control module 303. For all the pages included in the registered print job, in order from the first page, the job control module 303 transmits, to a page control module 304, pages for which processing is to be started and then starts page processing. Then, when the page control module 304 notifies that the processing of the next page can be started, the job control module 303 transmits a start of processing of the next page to the page control module 304, and this is repeated. When a notification that the processing has ended for all the pages is received from the page control module 304, the job control module 303 notifies the print job generation module 301 of an end of the print job.

When a notification to start page processing is received from the job control module 303, the page control module 304 controls the processing of each page. A data receiving module 302 receives PDL (Page Description Language) data transmitted from the information processing apparatus 102 via the communication unit I/F 208. A PDL analyzing module 305 analyzes the received PDL data and converts it into intermediate data. A RIP (Raster Image Processing) control module 306 rasterizes the intermediate data and converts it into bitmap image data.

An image generation module 307 generates corrected image data for printing by reflecting, in the generated bitmap image data, correction information for a sheet to be used for printing. Then, the image data is transferred to a patch combination module 309 of an engine control module 308. The image generation module 307 is responsible for controlling the image processing unit 207 of FIG. 2.

The engine control module 308 includes the patch combination module 309, a correction information storage module 310, a reference information storage module 311, a sensor control module 312, a sheet feeder management module 313, a sheet feed control module 314, and a print control module 315. The sensor control module 312 is responsible for controlling the colorimeter 210. In addition, the patch combination module 309, the correction information storage module 310, the reference information storage module 311, the sheet feeder management module 313, the sheet feed control module 314, and the print control module 315 are responsible for controlling the printer unit 209 of FIG. 2.

The patch combination module 309 combines the information on marks for tone correction (tone patches) with image data for printing so that the marks for tone correction are formed in addition to an image that is formed based on the corrected image data received from the image generation module 307. Then, the print control module 315 instructs printing of the combined image data.

The sheet feed control module 314 feeds and conveys a sheet accommodated in a sheet feeder by controlling the sheet feeder in accordance with an instruction of a print job. The print control module 315 prints the image data for printing and the image data for printing combined with tone patches onto sheets supplied by the sheet feed control module 314 and then discharges the sheets. In this embodiment, if necessary, an image is formed on a sheet based on the image data to which the information on marks for tone correction (tone patches) has been added.

The sensor control module 312 controls the colorimeter 210 to measure the marks for tone correction (tone patches) formed on a sheet and obtains colorimetric data.

The reference information storage module 311 holds, in association with the type of sheets set in the sheet feeder, reference information generated based on the colorimetric data obtained by the sensor control module 312. The correction information storage module 310 holds, in association with the type of sheets set in the sheet feeder, the correction information obtained by comparing the reference information held by the reference information storage module 311 with the colorimetric data obtained by the sensor control module 312. The sheet feeder management module 313 manages information on the sizes and types of sheets set in all the sheet feeders provided in the printing apparatus 101. In response to a request for registering sheets from a UI control module 316, the sheet feeder management module 313 clears the reference information associated with the type of sheet to be removed for replacement, which is held by the reference information storage module 311. In addition, when the correction information storage module 310 holds the correction information associated with the type of sheet to be removed for replacement, the sheet feeder management module 313 clears the correction information.

When the user sets information of a sheet in association with a sheet feeder by operating the console unit 206, the UI control module 316 requests the sheet feeder management module 313 to register the sheet. When it is requested to display the information of registered sheets, the information of sheets for which registration has been completed is displayed on the console unit 206. The UI control module 316 is responsible for controlling the console unit 206.

Figure 4A:
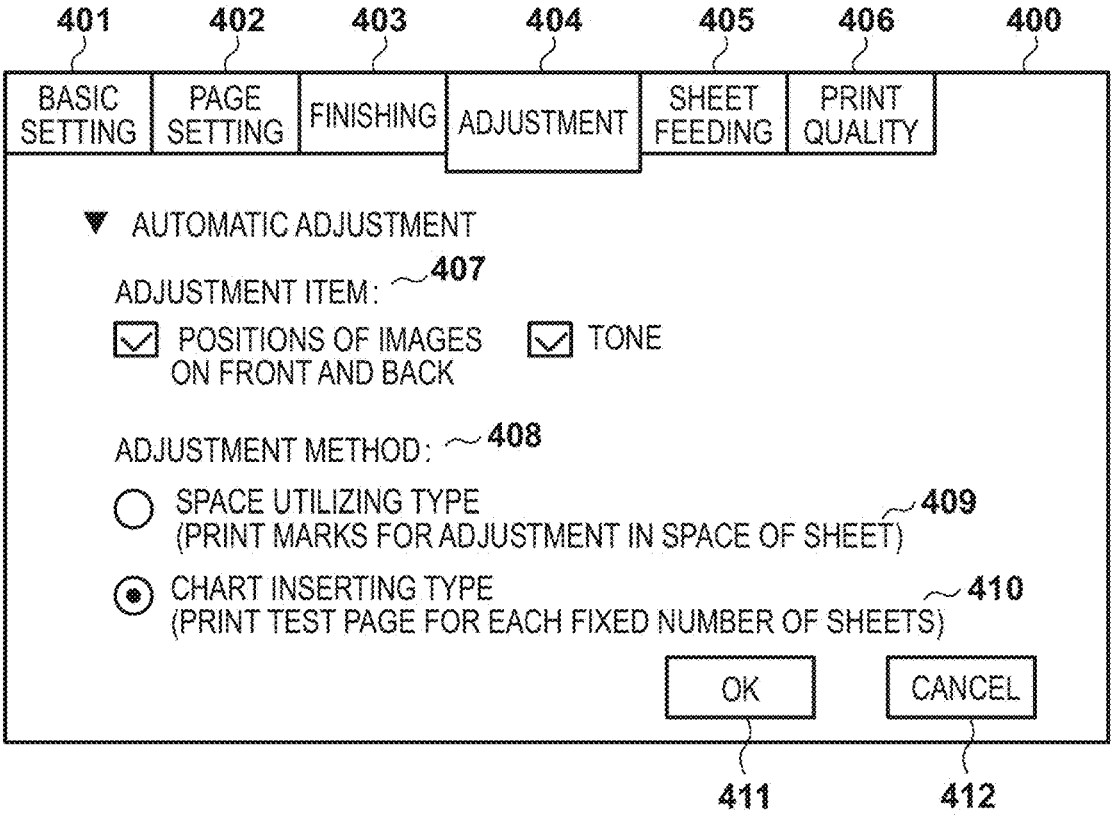
FIG. 4A is a diagram illustrating an example of a print setting screen of a printer driver that operates in an information processing apparatus according to the embodiment and is for a user to perform print settings for the printing apparatus.

FIG. 4A depicts a view illustrating an example of a print setting screen of a printer driver that operates in the information processing apparatus 102 according to the embodiment and is for a user to perform print settings for the printing apparatus 101.

A correction function for suppressing tone variation during printing by forming tone patches for tone correction on a sheet, measuring the patches with colorimetric sensors in real time, and feeding back correction information obtained by this to a subsequent page is called real-time multi-level correction. There are two types of real-time multi-level correction: a space utilizing type in which patches are printed using the space on a sheet to be printed and a chart inserting type (interrupt adjustment) in which, when the space on a sheet to be printed is unavailable, a dedicated sheet is inserted and patches are printed on the dedicated sheet. In the space utilizing type, feedback correction is performed by printing patches in the space on the sheet of each page on which image data inputted by the user is printed. In contrast, in the interrupt adjustment, feedback correction is performed by inserting a dedicated sheet at an insertion interval set in advance in the printing apparatus 101. Whether the real-time multi-level correction is executed by the space utilizing type or the interrupt adjustment is instructed by the user to the printing apparatus when inputting a print job. Since the present embodiment relates to a method of controlling the interrupt adjustment in which the space on a sheet to be printed cannot be used, description will be omitted for the detailed process of the space utilizing type, and the process of the interrupt adjustment type will be described in detail.

The print setting screen 400 indicates a printer driver screen. Tabs 401 to 406 include a basic setting tab 401, a page setting tab 402, a finishing tab 403, an adjustment tab 404, a paper feeding tab 405, and a print quality tab 406.

When any of these tabs 401 to 406 is selected, a setting screen corresponding to the selected tab is displayed. FIG. 4A illustrates an example of a setting screen for when the adjustment tab 404 has been selected.

An adjustment item 407 is used for selecting, using the check box, an item of the type of adjustment to be performed. In the figure, both "positions of images on front and back" and "tone" are selected. The adjustment performed using inline sensors includes real-time multi-level correction for adjusting image quality, which will be described in the present embodiment, and front and back registration adjustment for adjusting an image forming position, for which description will be omitted in the embodiment. In FIG. 4A, "tone" for performing real-time multi-level correction and "positions of images on front and back" for performing front and back registration adjustment are selected, but here, only the real-time multi-level correction will be described.

An adjustment method 408 is configured so as to select the method of adjusting the above adjustment items to be either a space utilizing type 409 or an interrupt adjustment (chart inserting type) 410. In FIG. 4A, the interrupt adjustment (chart inserting type) 410 is selected.

As another tab, when the basic setting tab 401 is selected, a menu that allows basic printing settings, such as the number of copies, the orientation of printing, the magnification, and the output method, is displayed. When the page setting tab 402 is selected, a menu for setting the page layout, the magnification, and the like of the output image is displayed. When the finishing tab 403 is selected, a menu that allows the setting of single-sided/double-sided printing, the setting of binding direction, the setting of the discharge method, and the like is displayed. When the paper feed tab 405 is selected, a menu for selecting sheets of which sheet feeder of the printing apparatus 101 are to be used at the time of output is displayed. When the print quality tab 406 is selected, a menu for setting the image quality and the like of the output image, such as the color mode (color/monochrome) and the resolution setting, is displayed. When the user presses an OK button 411 on the print setting screen 400, the information processing apparatus 102 generates a print job and transmits the print job to the printing apparatus 101 via the LAN 100. The cancel button 412 cancels the setting of the screen 400 and transitions to the screen before the screen 400 was displayed.

Figure 4B:
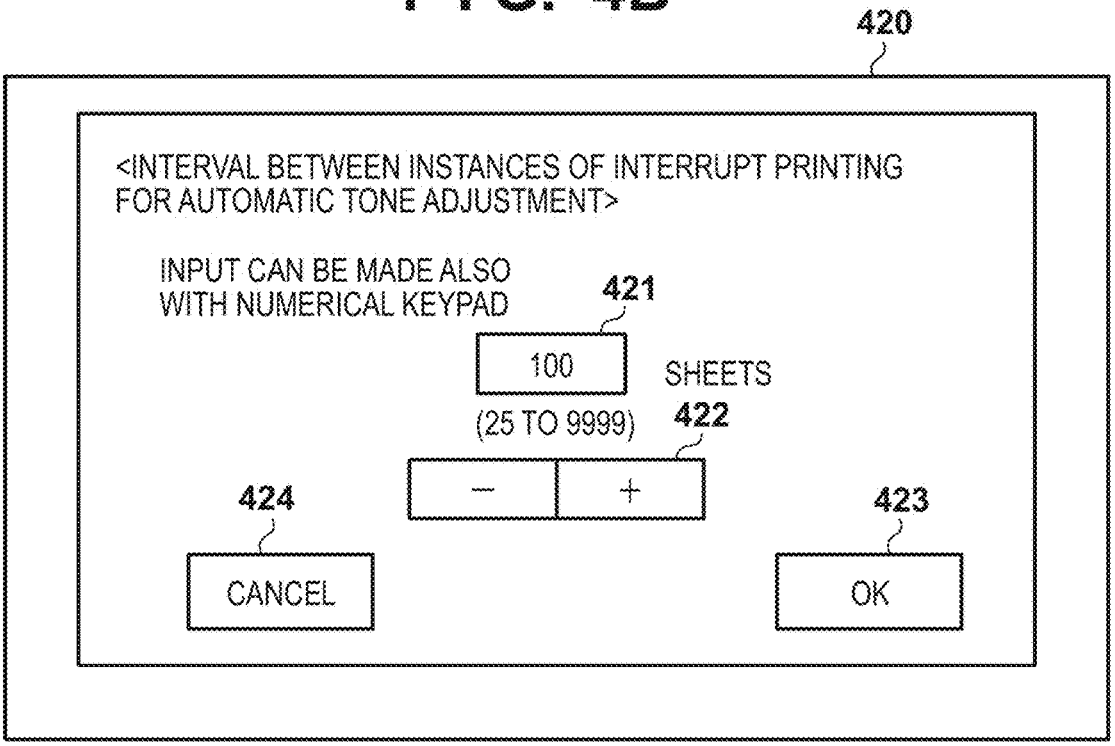
FIG. 4B is a diagram illustrating an example of a setting screen to be displayed on a console unit of the printing apparatus according to the embodiment.

FIG. 4B depicts a view illustrating an example of a setting screen to be displayed on the console unit 206 of the printing apparatus 101 according to the embodiment.

The setting screen 420 is displayed when a print job, for which "tone" is designated as the adjustment item 407 and the "chart inserting type" 410 is designated as the adjustment method 408 from the printer driver in FIG. 4A, is generated and then transmitted to the printing apparatus 101. This setting screen 420 is a screen for designating, in the case of the chart inserting type of real-time multi-level correction, an interval between instances of interrupt printing of the insertion sheet on which only the tone patches are printed. In a numeric field 421, it is possible to input any value for designating, by pressing numeric keys (not illustrated) of the console unit 206 or minus and plus keys 422, an interval between instances of printing of an insertion sheet. When the input of a numerical value is completed, the user completes the setting by pressing an OK button 423. When a cancel button 424 is pressed, the setting of this screen is cancelled, and the screen that was previously displayed is returned to. The printing apparatus 101 receives the setting value of the chart inserting type using the setting screen 420 and performs control based on it. The information that has been set via this screen is held in the reference information storage module 311 for each type of sheet.

Subsequently, the printing position of the information on the marks for tone correction (tone patches) for tone correction according to the embodiment, the color sensors for measuring the printed color patches, and the management table for holding the signal values from the color sensors and the correction information derived from the signal values will be described with reference to FIGS. 8A and 8B and FIGS. 9A to 9C.

Figure 8A:
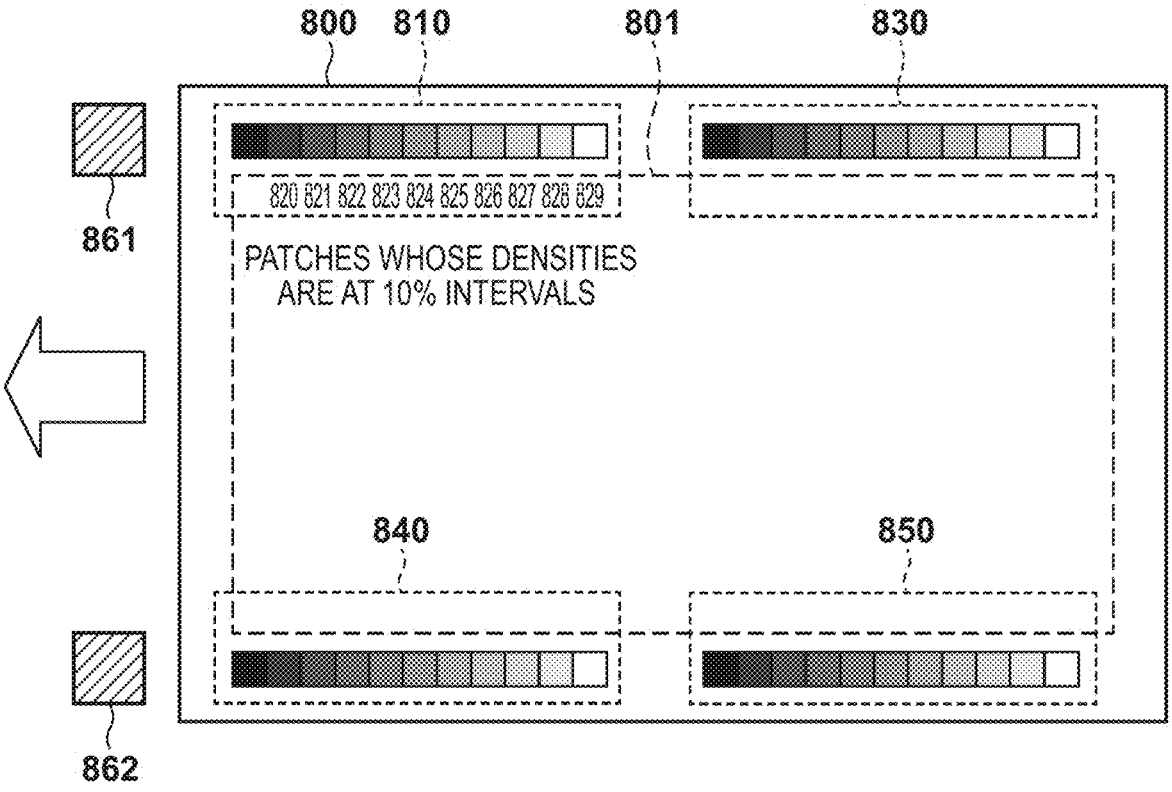
FIG. 8A is a diagram illustrating an example of outputting information on marks for tone correction (tone patches) for real-time tone correction according to the embodiment.

FIG. 8A is a diagram illustrating an example of outputting information on marks for tone correction (tone patches) for real-time tone correction according to the embodiment.

The patches required for performing multi-level correction in real time are printed in the regions of space defined inside a printing sheet 800 and outside a print guaranteeing region 801 of the sheet. The print guaranteeing region 801 is a portion that becomes the final product and is a region that guarantees printing of user images. Meanwhile, although it is possible to form images in some areas outside the print guaranteeing region 801, it is assumed that they are cut and removed from the final product.

The patches for real-time tone correction are printed side by side on the outside of the print guaranteeing region 801, and the patches are read by sensors 861 and 862 on a printed surface side. Therefore, the patches of each color are arranged in a direction that is parallel to the conveyance direction in accordance with the positions of these sensors 861 and 862. The printing sheet 800 is printed with a set of cyan patches 810, a set of magenta patches 850, a set of yellow patches 830, and a set of black patches 840. In each set of patches, 10 patches of that color are placed at densities of 10% increments, and a total of 40 patches are printed for four sets.

For example, the set of cyan patches 810 includes cyan patches 820 to 829; the leftmost cyan patch 820 is at a 100% density, the density decreases at increments of 10% rightward thereafter, and the rightmost cyan patch 829 is at a 10% density. Each set of patches of magenta, yellow, and black colors is configured the same by 10 patches, and feedback information necessary for tone correction is generated only after the reference values for four colors and data of measurement values have been obtained. These patch groups are combined by the patch combination module 309 into the image data generated by the image generation module 307.

In the embodiment, since the proposal relates to a method of inserting a sheet on which only tone patches are printed in order to print the patch group for a sheet whose space of the print product cannot be utilized, it is also permitted to print the patch groups in the print guaranteeing region 801. However, in order to perform real-time tone correction by reading the patch groups using the same sensor as when the space on the print product is utilized, it is assumed that these patch groups are to be printed outside the print guaranteeing region 801.

Figure 8B:
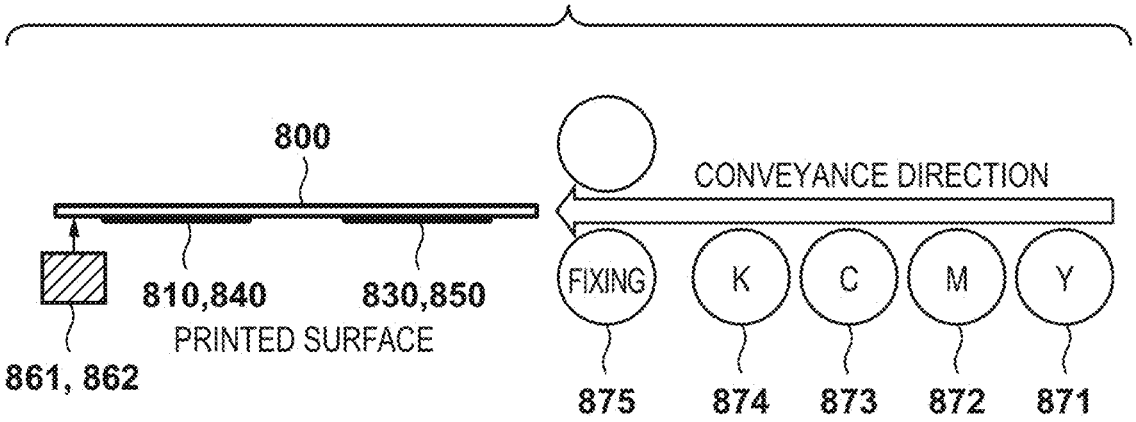
FIG. 8B is a cross-sectional diagram of a conveyance path of the printing apparatus seen from the side.

FIG. 8B is a cross-sectional diagram of a conveyance path of the printing apparatus 101 seen from the side.

The toner of each corresponding color is transferred to the printing sheet 800 by developing devices 871 to 874 of the respective colors YMCK, and the fixing process is performed by the fixing device 875. Then, each patch of the sets of patches 810, 830, 840, and 850 is read by the color sensors 861 and 862 installed at the left and right ends in the conveyance direction and on the printed surface side of the sheet.

FIG. 9A is a diagram illustrating an example of reference information, measurement values, and correction information generated based on CMYK density information scanned by the color sensors 861 and 862.

As illustrated in FIG. 8A, since a total of 40 patches, 10 patches for each of CMKY, are printed on the printing sheet 800, when these patches are read by the color sensors 861 and 862, 40 measurement values are obtained. In the embodiment, the sensor control module 312 digitizes the patch densities read by the color sensors 861 and 862 in 1024 levels and stores them. The colorimetric results notified from the sensor control module 312 are held, as the reference information in association with the type of sheet set in the sheet feeder, in the reference information storage module 311. As described above, these colorimetric results are managed for each type of sheet.

When the colorimetric results of the sheet notified from the sensor control module 312 are the type of sheet unregistered in the reference information storage module 311, the 40-point colorimetric results are stored as new reference information 881. When the colorimetric results of the sheet notified from the sensor control module 312 are the type of sheet that has been registered in the reference information storage module 311, the colorimetric results are handled as new measurement values 882, and correction information 883 is calculated from the difference between the reference information 881 and the measurement values 882. This correction information is stored in the correction information storage module 310. Although the correction information is stored in the present embodiment, configuration may be taken so as to store the measurement values 882 and calculate the correction information from the difference between the reference information 881 and the measurement value 882 every time.

FIG. 9B is a diagram illustrating an example of a table in which the reference information storage module 311 manages the reference information. The record information includes each item of a type of sheet 891, a target sheet feeder 892, reference information (1/2 speed) 893, reference information (1/1 speed) 894, a generated pages 895, and a Timestamp (date/time information) 896.

According to the reference information in the table in FIG. 9B, it can be seen that plain paper 3 is set in a sheet feeder 1 (CST1) and the printing processes for 60014 pages, as indicated by the generated pages 895, have been executed cumulatively since the power was turned on at 10:04:06 on 2019/07/18. In addition, "plain paper 3" is fed from the "sheet feeder 1" at "1/1 speed", and colorimetry is performed for the printing result and then the result is registered as reference information. When "plain paper 3" is removed from the "sheet feeder 1", this record information is deleted.

FIG. 9C is a diagram illustrating an example of a table in which the correction information storage module 310 manages the correction information. The basic configuration of this table is the same as that of the table that manages the reference information in FIG. 9B, except that the reference information is replaced by the correction information. In other words, the record information includes each item of the type of sheet, a target sheet feeder 897, correction information (1/2 speed) 898, correction information (1/1 speed) 899, the generated pages, and the Timestamp (date/time information). In this case as well, when the corresponding sheet is removed from the target sheet feeder 897, the record information thereof is deleted.

Figure 5:
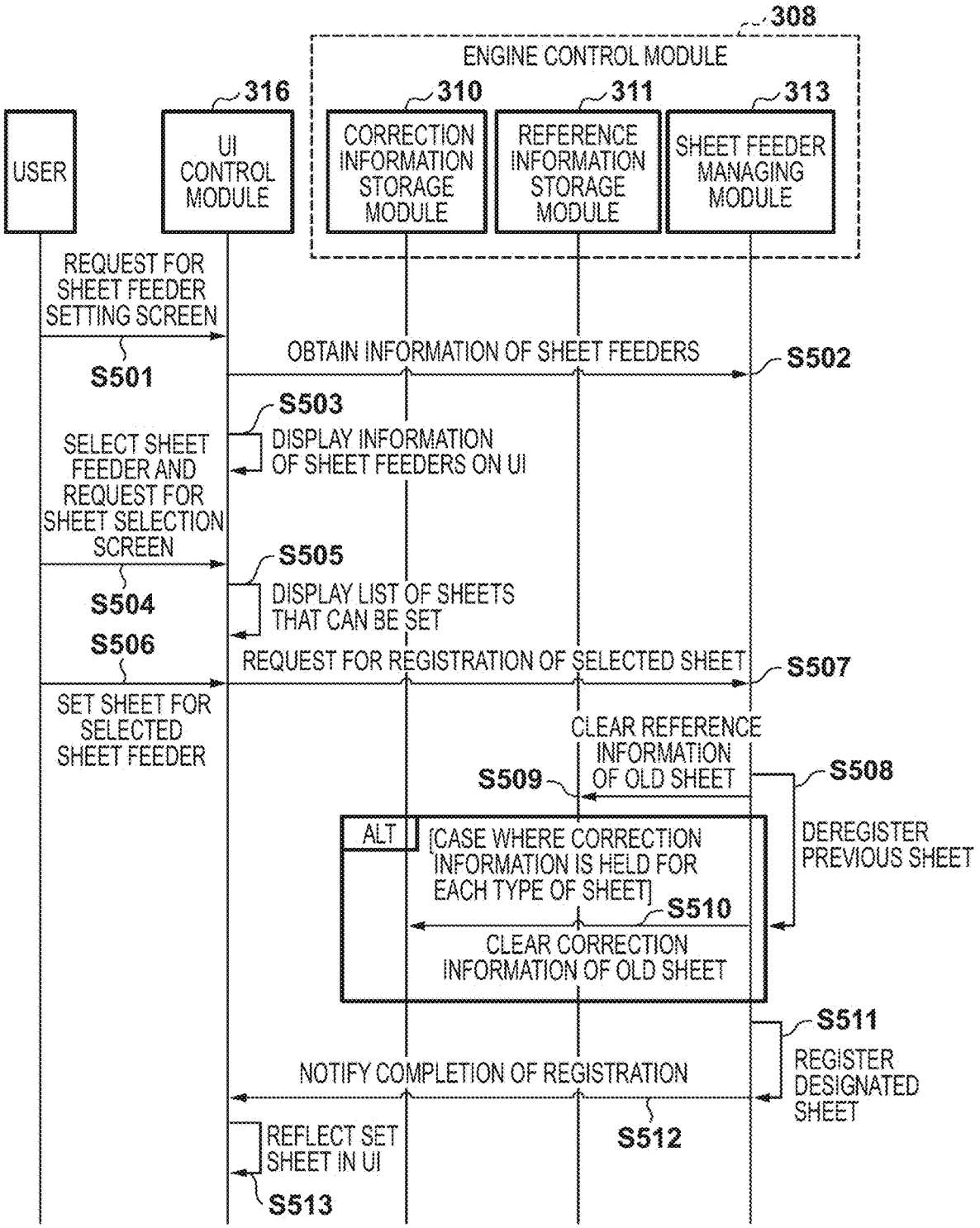
FIG. 5 is a sequence diagram for explaining a process of registering correction information in the printing apparatus according to the embodiment.

FIG. 5 is a sequence diagram for explaining a process of registering correction information in the printing apparatus 101 according to the embodiment. This process is realized by the CPU 201 of the printing apparatus 101 deploying a program stored in ROM 202 to RAM 203 and executing the program.

When the printing apparatus 101 prints an image on a sheet, the properties for printing the image differ depending on the type of sheet. Therefore, in order for the printing apparatus 101 to correctly perform tone correction, it is necessary to hold the reference information for each type of sheet. The printing apparatus 101 supports a large number of types of sheets, but since sheets to be actually used need to be set in a sheet feeder, the reference information storage module 311 holds only the reference information of the type of sheets set in the sheet feeder. Therefore, when the user sets new sheets in the sheet feeder of the printing apparatus 101, the reference information and the correction information for the type of sheets to be removed for replacement are cleared.

First, in step S501, the user selects a screen for setting sheet feeders by operating a UI screen displayed on the console unit 206 of the printing apparatus 101. Next, in step S502, when an operation from the user is received, the UI control module 316 of the printing apparatus 101 obtains, from the sheet feeder management module 313, information on the size and type of the sheets set in all the sheet feeders provided in the printing apparatus 101. Then, in step S503, the UI control module 316 displays, on the UI screen, the information obtained in step S502. An example of this screen is illustrated in FIG. 7A.

Figure 7A:
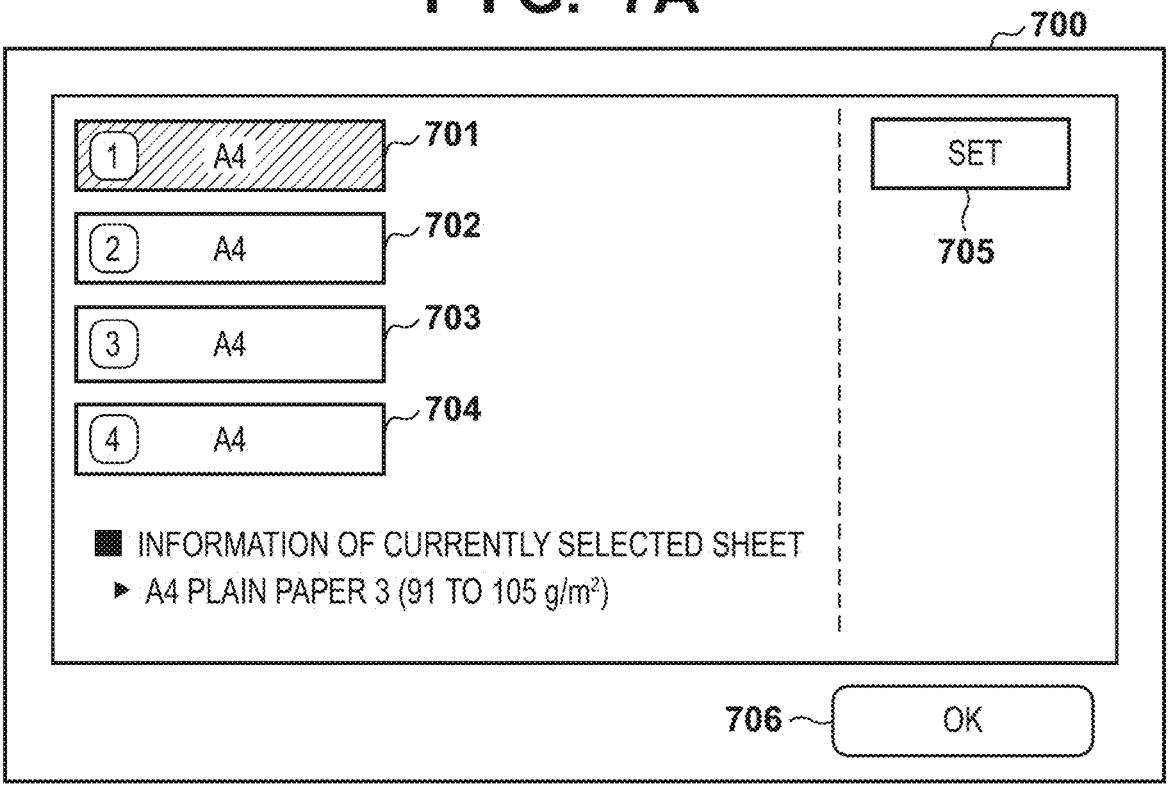
FIGS. 7A and 7B are diagrams illustrating examples of setting screens for registering the types of sheets with the sheet feeders of the printing apparatus according to the embodiment.

FIG. 7A is a diagram illustrating an example of a sheet feeder setting screen for registering the types of sheets with the sheet feeders of the printing apparatus 101 according to the embodiment.

Figure 7B:
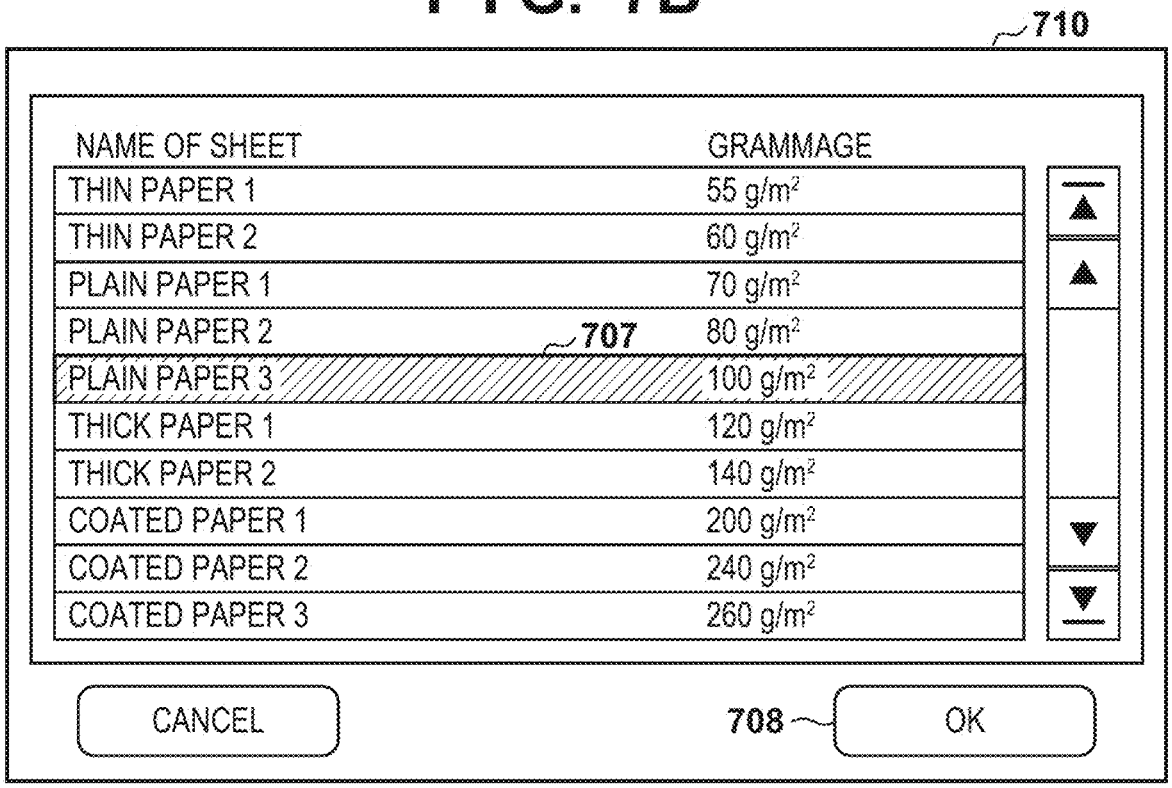

Here, the UI control module 316 queries the sheet feeder management module 313 on the setting information of the current sheet feeder, and the result is displayed on a screen 700. On this screen 700, the printing apparatus 101 has four sheet feeders, and buttons 701 to 704 corresponding to each of them are displayed. In the example in the figure, the button 701 corresponding to a sheet feeder 1 is selected. When a set button 705 is pressed in this state, a screen 710 of FIG. 7B is displayed. In this screen, the user can select the type of sheet to be set for the sheet feeder selected in FIG. 7A. In FIG. 7B, "plain paper 3" 707 is selected.

Returning to FIG. 5, in step S504, the user selects, from the UI screen (FIG. 7A) of the printing apparatus 101, the sheet feeder for which the user wants to change the sheets and presses the set button 705. Accordingly, in step S505, the UI control module 316 of the printing apparatus 101 displays, on the UI screen, a list of the types of sheets that can be set in the selected sheet feeder, as illustrated in FIG. 7B. Then, in step S506, the user selects, on the screen in FIG. 7B, the type of sheet to which the user wants to change and presses an OK button 708. By this, the screen 700 of FIG. 7A is returned to, and when an OK button 706 is pressed on the screen 700, the sheet feeder setting screen 700 is closed and the registration of the type of sheet with the sheet feeder is executed. Accordingly, in step S507, the UI control module 316 of the printing apparatus 101 requests the sheet feeder management module 313 to register the sheet feeder and the type of sheet selected by the user. In the examples of FIGS. 7A and 7B, it is requested to register "plain paper 3" with the sheet feeder 1.

Accordingly, in step S508, the sheet feeder management module 313 updates the information stored in the reference information storage module 311 and the correction information storage module 310. Details of this process will be described later with reference to the flowcharts of FIGS. 6A and 6B. When the sheet feeder management module 313 determines that it is necessary to clear the reference information and the correction information at this time, in steps S509 and S510, the process of clearing the reference information and the correction information is performed. In step S509, the sheet feeder management module 313 clears the reference information for the type of sheet to be removed for replacement stored in the reference information storage module 311. Further, in step S510, the sheet feeder management module 313 determines whether or not the correction information for the type of sheet to be removed for replacement is present in the correction information storage module 310 and, if the correction information is present, clears the correction information. In this way, when the series of processes in step S508 is completed, in step S511, the sheet feeder management module 313 performs the process of registering the type of sheet designated by the user. Then, in step S512, the UI control module 316 is notified of the completion of registration. Then, in step S513, the UI control module 316 updates the UI screen based on the information of the type of sheet that has been registered.

The above process will be described again with reference to FIGS. 7A and 7B. The user selects, on the screen 700 of FIG. 7A, a sheet feeder for which to set the type of sheet. After selecting a particular sheet feeder (here, the sheet feeder 1), the user presses the set button 705 to set the type of sheet (step S504) and invokes the sheet type setting screen 710 illustrated in FIG. 7B (step S505).

In the sheet type selection screen 710, one that matches the type of sheet that is set or is to be set in the sheet feeder selected on the screen 700 is selected. Here, it is assumed that "plain paper 1" is replaced by "plain paper 3" (step S506). Then, when the OK button 708 in FIG. 7B is pressed, the screen 700 is returned to. After confirming in this way that they were able to change the type of sheet, the user presses the OK button 706. Accordingly, the UI control module 316 notifies the sheet feeder management module 313 of the setting by the user (step S507) and then makes a registration request (step S508).

Figure 6A:
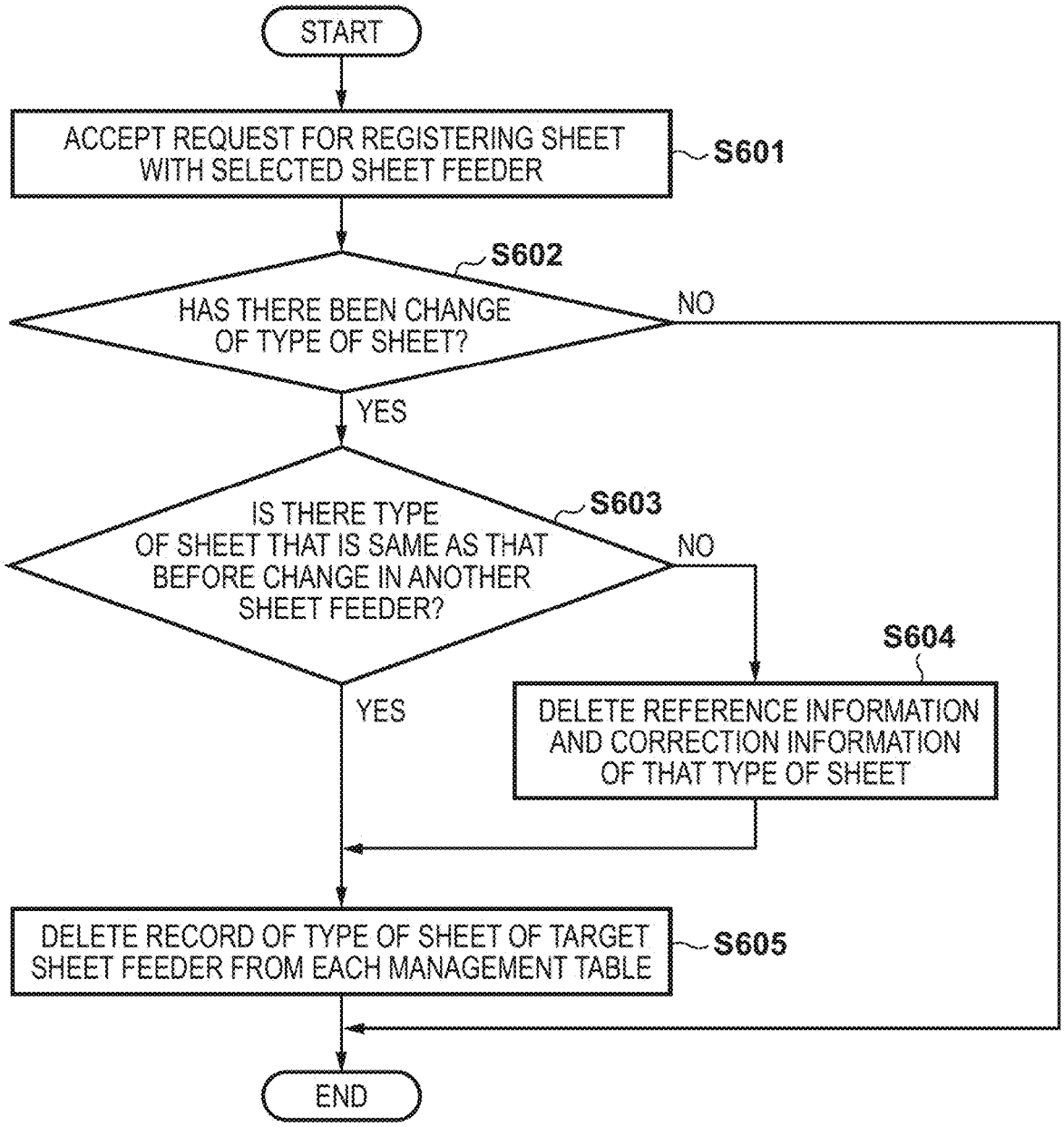
FIGS. 6A and 6B are flowcharts for explaining processes associated with a change of the type of sheet registered with each sheet feeder of the printing apparatus according to the embodiment.
Figure 6B:
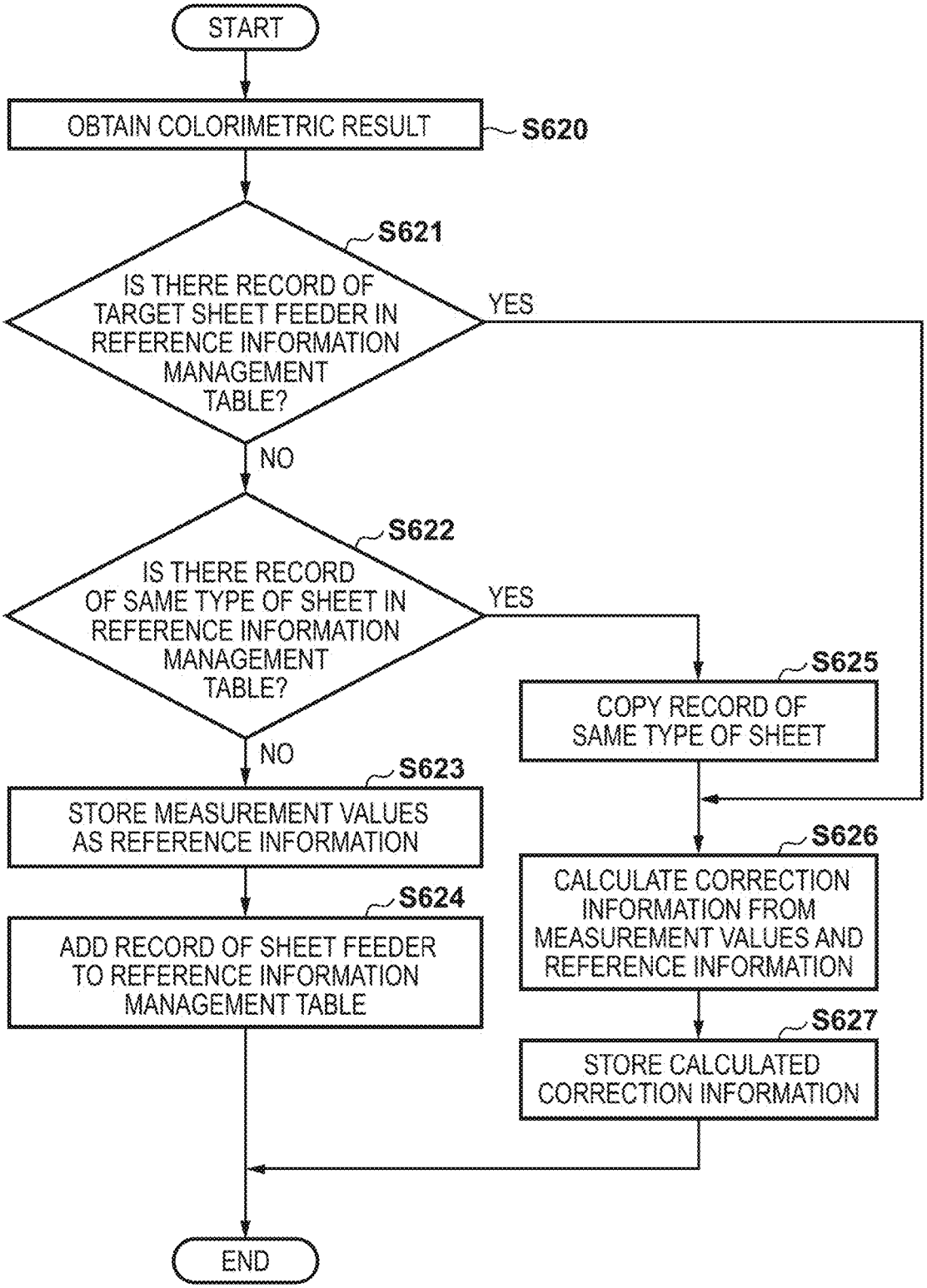

FIGS. 6A and 6B are flowcharts for explaining processes associated with a change of the type of sheet registered with each sheet feeder of the printing apparatus 101 according to the embodiment. The process described in the flowcharts is accomplished by the CPU 201 executing a program which has been deployed into the RAM 203.

FIG. 6A is a flowchart for explaining a process of clearing the reference information and the correction information for each type of sheet. This flowchart indicates a process performed by the CPU 201 functioning as the sheet feeder management module 313 when registration of the type of sheet selected by the user with the sheet feeder is requested in step S507 of FIG. 5 described above.

First, in step S601, the CPU 201 functions as the sheet feeder management module 313 and receives a request for registering the sheet feeder and the type of sheet selected by the user via the console unit 206. Next, the process proceeds to step S602, and the sheet feeder management module 313 determines whether or not there has been a change of the type of sheet in the sheet feeder. Here, if there is no change (in the case of re-registration of the same type of sheet), this process ends. Meanwhile, if there is the change, the process proceeds to step S603. In step S603, the sheet feeder management module 313 determines whether the sheet of the same type as the type of sheet that had been set in the sheet feeder to be changed is set in another sheet feeder. If there is the same type of sheet in another sheet feeder, the process proceeds to step S605, and if not, the process proceeds to step S604. In step S604, since the sheet feeder management module 313 will no longer use the type of sheet before the change in any of the sheet feeders, the reference information and the correction information (the tables 881 and 883 in FIG. 9A) of the corresponding type of sheet are deleted from the reference information storage module 311 and the correction information storage module 310, and the process proceeds to step S605. In step S605, the sheet feeder management module 313 deletes, from the reference information managing table and the correction information managing table (FIG. 9C), the record of the type of sheet of the sheet feeder for which settings are to be changed.

FIG. 6B is a flowchart for explaining registration of the reference information and the correction information for each type of sheet. This flowchart indicates a process to be executed by the CPU 201 functioning as the reference information storage module 311 or the correction information storage module 310 when a notification of a colorimetric result is received from the sensor control module 312.

In step S620, the CPU 201 functions as the reference information storage module 311 and obtains a colorimetric result of the sensors. Next, the process proceeds to step S621, and the reference information storage module 311 determines whether or not the record of the sheet feeder associated with the colorimetric result notified from the sensor control module 312 is registered in the reference information management table of FIG. 9B, for example. Here, when it is determined that it is not registered, the process proceeds to step S622, and when it is determined that it is registered, the process proceeds to step S626. In step S622, the reference information storage module 311 determines whether or not the type of sheet associated with the colorimetric result is registered with another sheet feeder in the reference information management table. Here, if it is determined that it is not registered, the process proceeds to step S623. In step S623, the reference information storage module 311 stores the colorimetric result obtained in step S620 as the reference information (the table 881 in FIG. 9A). Then, the process proceeds to step S624, and the reference information storage module 311 adds the record of the sheet feeder associated with the colorimetric result obtained in step S620 to the reference information management table. In this way, a linking process of referencing the reference information stored in step S623 is performed, and this process is ended.

Meanwhile, in step S622, when the reference information storage module 311 determines that the type of sheet associated with the colorimetric result obtained in step S620 is registered with the another sheet feeder in the reference information management table, the process proceeds to step S625. In step S625, the reference information storage module 311 copies, to the reference information management table, as a record of the sheet feeder associated with the colorimetric result obtained in step S620, a record of the same type of sheet that has already been registered in the reference information management table. This results in the storing of the reference information of this type of sheet. Then, the process proceeds to step S626, and the reference information storage module 311 calculates the correction information from the measurement value and the reference information and notifies the correction information storage module 310 of the calculated correction information. Then, in step S627, the CPU 201 functions as the correction information storage module 310 and updates the correction information management table (FIG. 9C) based on the content notified from the reference information storage module 311 and then ends the process.

First Embodiment

An example of applying real-time multi-level correction to an actual print job using the tone patches, reference information, correction information, setting screen, and the like described above will be described. Specifically, a basic operation of interrupt adjustment in which, during the output of a print job, a sheet on which colorimetric patches for tone correction have been formed is inserted and measured in real time by colorimetric sensors and the correction information is continuously fed back to a subsequent page will be described with reference to FIGS. 10A, 10B, 11A and 11B.

Figure 10A:
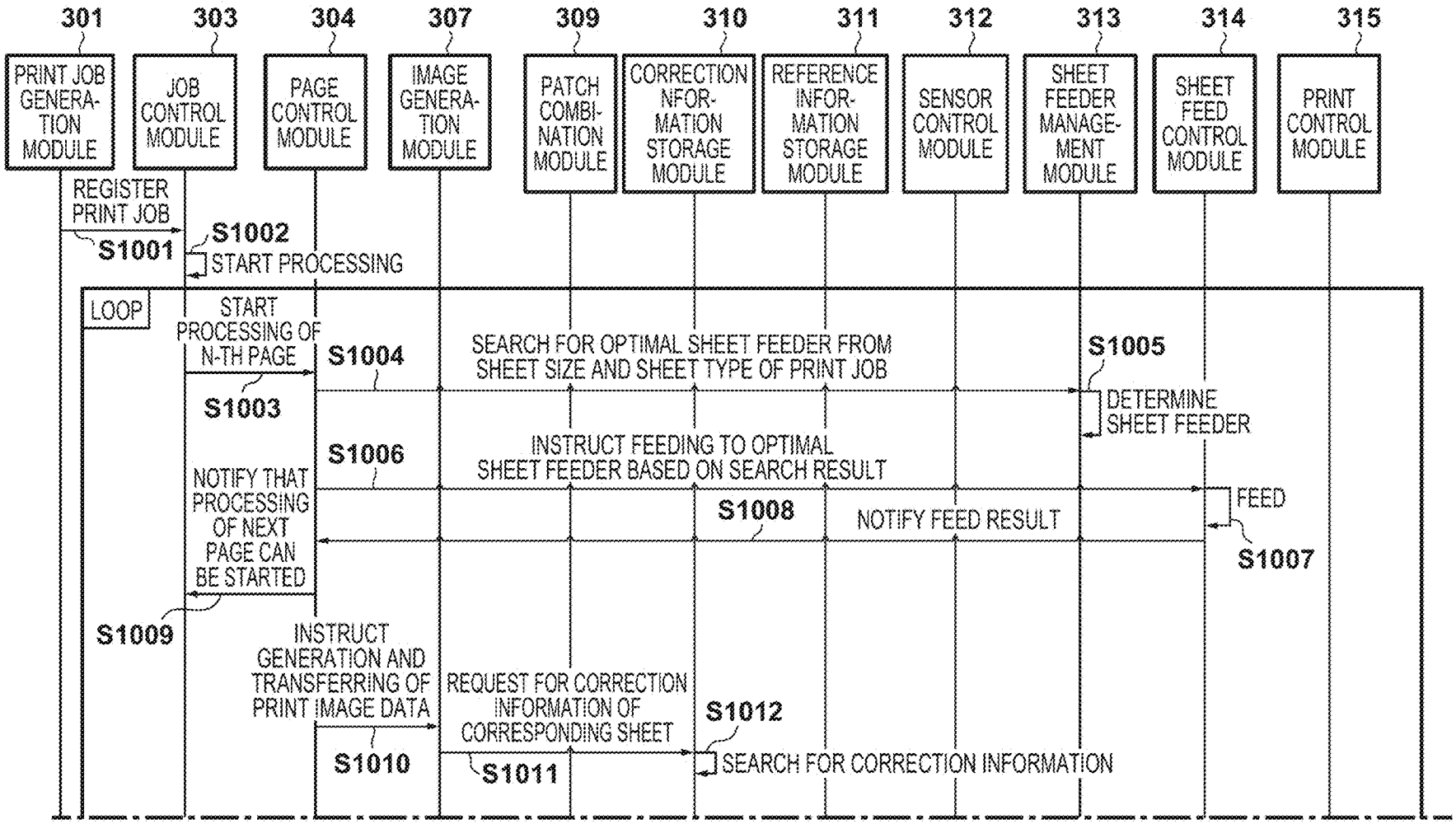
FIGS. 10A and 10B are sequence diagrams for explaining a printing process performed by the printing apparatus according to a first embodiment.
Figure 10B:
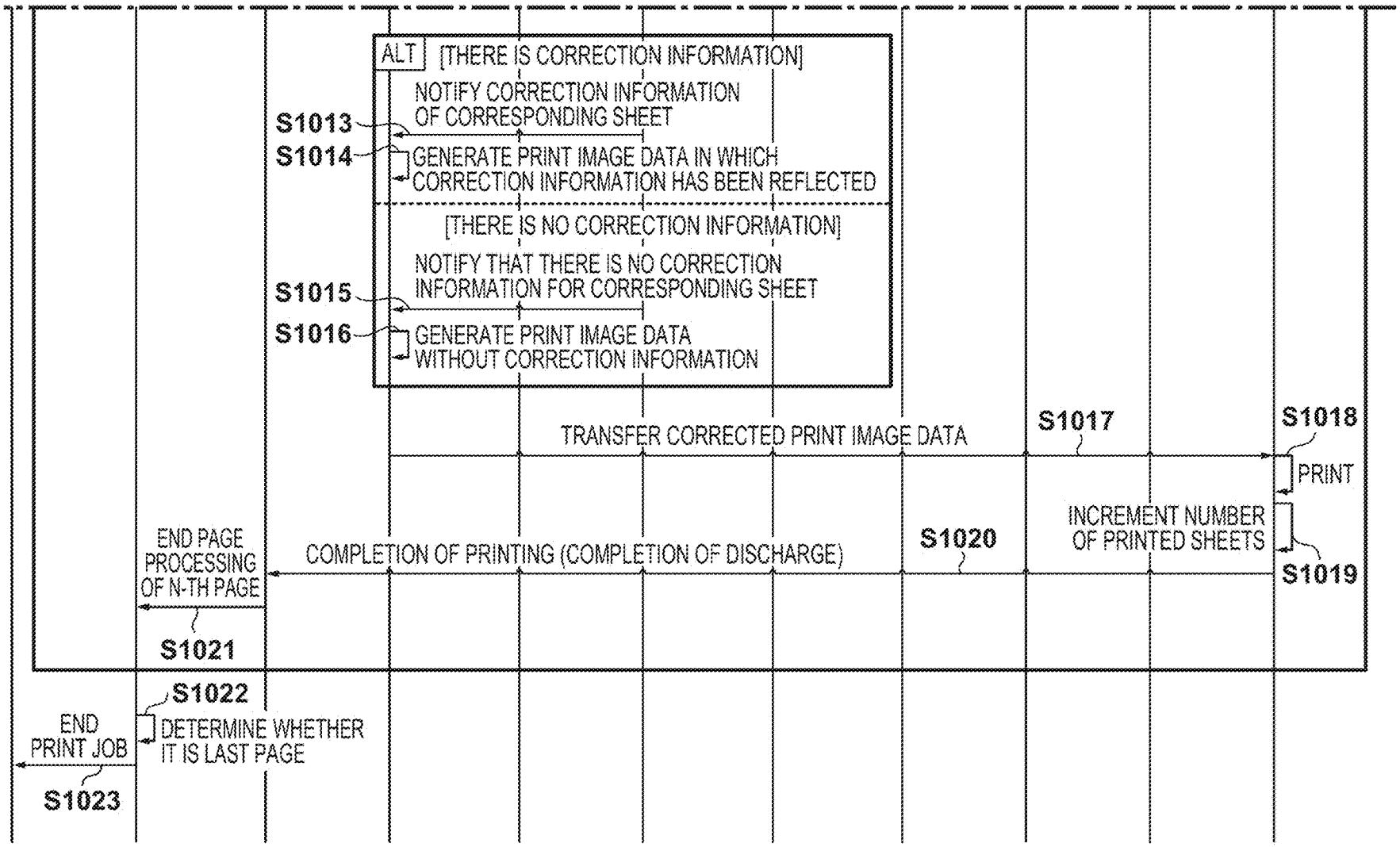

FIGS. 10A and 10B are sequence diagrams for explaining a printing process performed by the printing apparatus 101 according to a first embodiment. This sequence is realized by the CPU 201 of the printing apparatus 101 executing a program which has been deployed into the RAM 203.

First, in step S1001, the print job generation module 301 generates a print job and registers the generated print job in the job control module 303. Accordingly, in step S1002, the job control module 303 determines the execution order of the registered print job and starts processing in sequence. When the processing of the print job is started in the job control module 303, in step S1003, a start of the processing of an N-th page is notified to the page control module 304. Here, N is an integer whose initial value is "1", and is incremented by 1 when the processing of one page is completed. When the start of processing the N-th page is received from the job control module 303, the page control module 304 queries the sheet feeder management module 313 on from which sheet feeder to feed based on the sheet size and the sheet type designated for the page in step S1004. In step S1005, the sheet feeder management module 313 determines from which sheet feeder to feed based on the designated sheet size and sheet type. Then, the result is returned to the page control module 304. In step S1006, the page control module 304 instructs the sheet feed control module 314 to feed from the sheet feeder determined by the sheet feeder management module 313. In step S1007, the sheet feed control module 314 feeds from the instructed sheet feeder in accordance with a feeding instruction from the page control module 304. Then, in step S1008, the result of the feeding is notified to the page control module 304.

When a normal feeding result is received from the sheet feed control module 314, in step S1009, the page control module 304 notifies the job control module 303 that the processing of the next page can be started together with the information on the sheet feeder from which feeding is to be performed and the type of sheet. When the normal feeding result is received from the sheet feed control module 314, in step S1010, the page control module 304 instructs the image generation module 307 to generate and transfer the print image data. At this time, the sheet feeder from which feeding is to be performed, the sheet size, and the sheet type are notified from the page control module 304 to the image generation module 307. Thus, when the instruction to generate and transfer the print image data is received, in step S1011, the image generation module 307 requests the correction information storage module 310 for the correction information based on the notified information. Thus, in step S1012, the correction information storage module 310 searches for whether the correction information corresponding to the information is stored in the RAM 203. When the corresponding correction information is detected, in step S1013, the correction information storage module 310 notifies the image generation module 307 of the correction information. In step S1014, the image generation module 307 generates print image data using the correction information notified from the correction information storage module 310.

Meanwhile, when the correction information corresponding to the passed information cannot be detected, in step S1015, the correction information storage module 310 notifies the image generation module 307 that there is no correction information. When there is no correction information, in step S1016, the image generation module 307 generates the print image data without correction. In step S1017, the image generation module 307 transmits the generated print image data to the print control module 315 and instructs printing. Accordingly, in step S1018, the print control module 315 prints an image on a sheet fed by the sheet feed control module 314 based on the received image data. In the image printed here, the information on marks for tone adjustment is not combined. When printing is completed in this way, in step S1019, the print control module 315 increments (counts) a counter for the number of sheets discharged and stores it in the RAM 203. Further, in step S1020, the print control module 315 notifies the page control module 304 of completion of printing (completion of discharge). Accordingly, when a print completion (discharge completion) notification is received from the print control module 315, in step S1021, the page control module 304 notifies the job control module 303 of completion of processing of the N-th page. When the completion of processing of the N-th page is received, in step S1022, the job control module 303 determines whether or not the N-th page is the last page of the print job. When it is determined that the completion of printing of the final page has been received, in step S1023, the job control module 303 notifies the print job generation module 301 of the end of the print job. If the N-th page is not the last page of the print job, the process proceeds to step S1003 again and the processing of the next page starts.

Figure 11A:
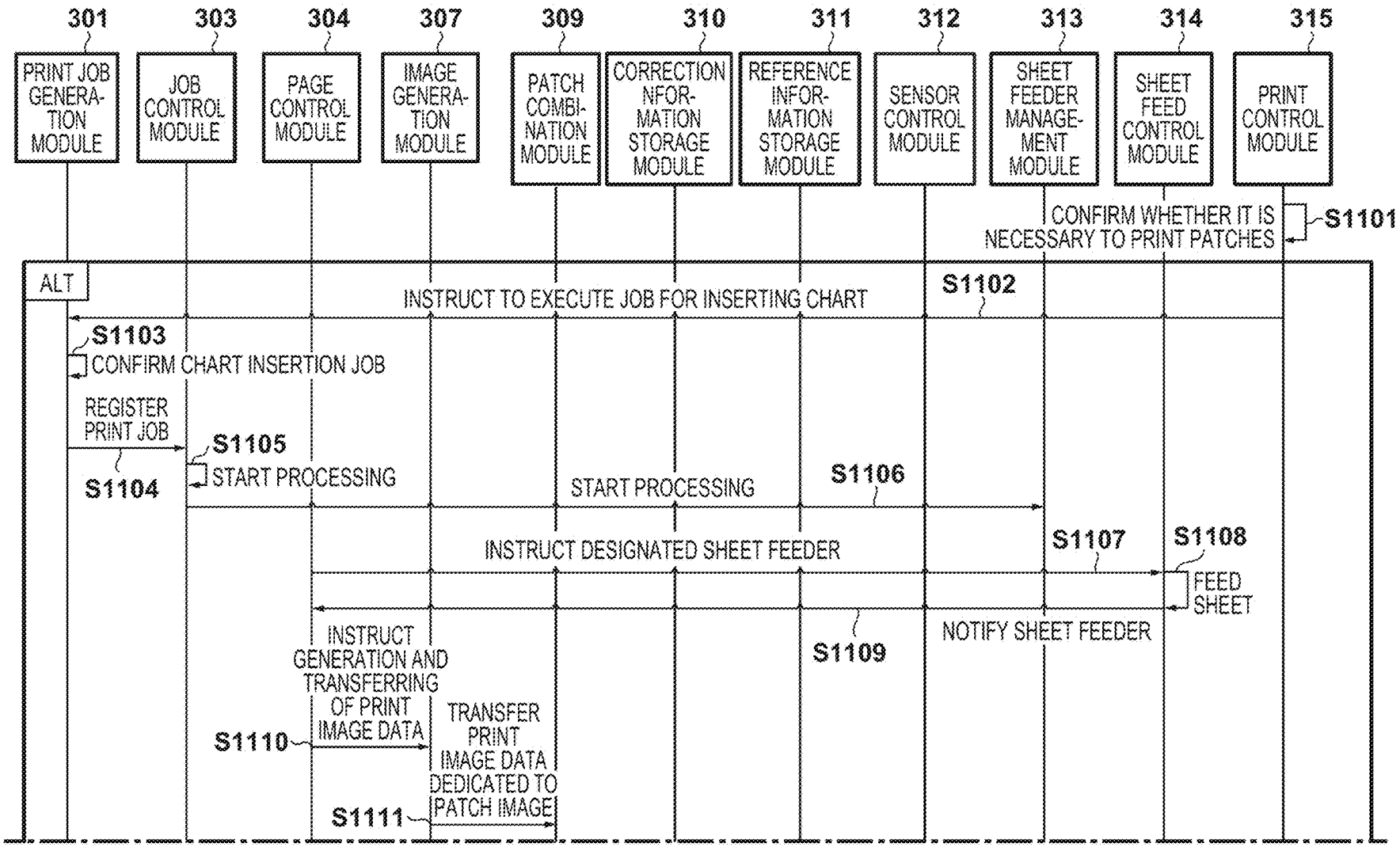
FIGS. 11A and 11B are sequence diagrams for explaining a process of printing patches for tone correction and inserting a sheet performed by the printing apparatus according to the first embodiment.
Figure 11B:
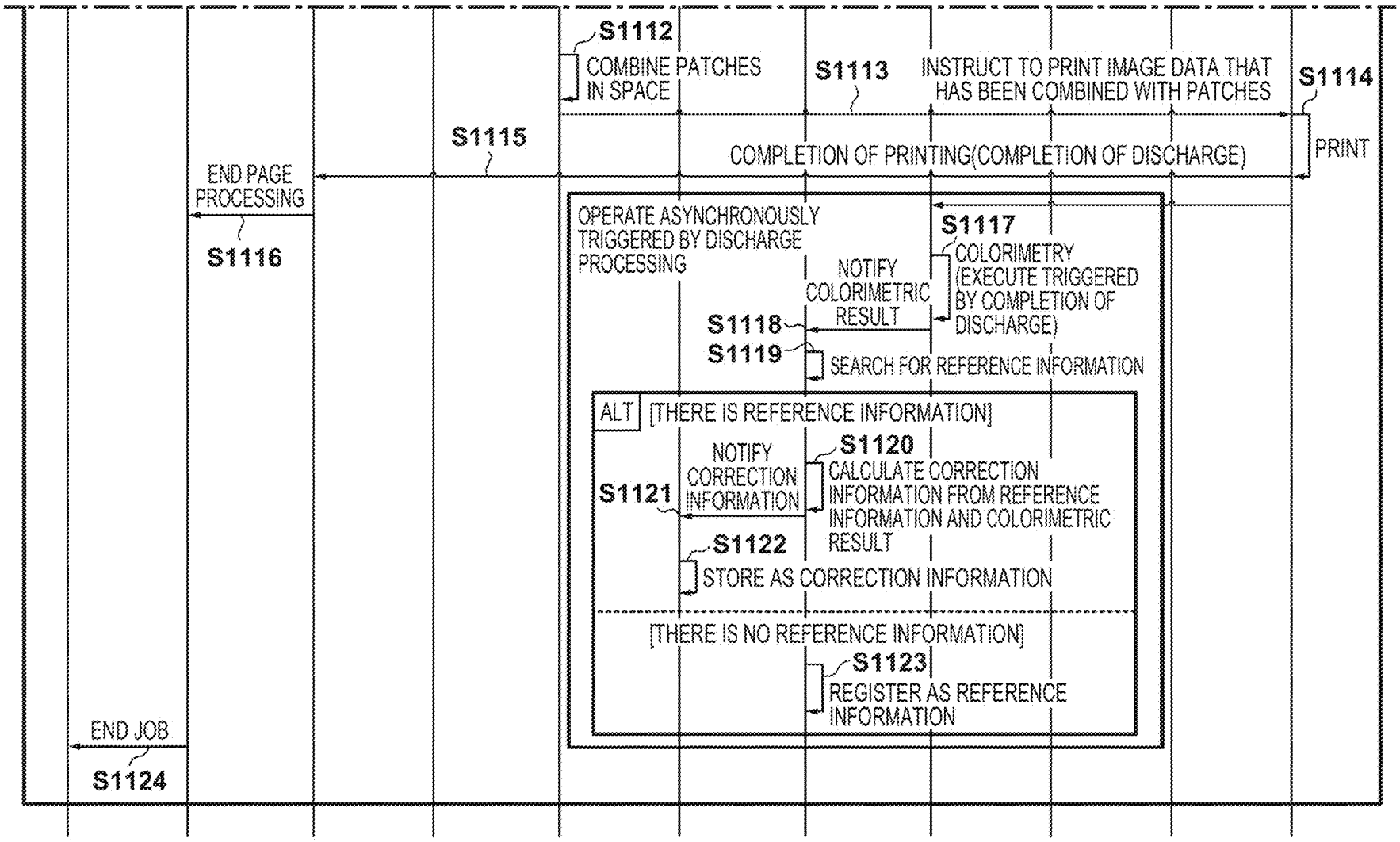

FIGS. 11A and 11B are sequence diagrams for explaining a process of printing patches for tone correction and inserting a sheet by the printing apparatus 101 according to the first embodiment. This sequence is realized by the CPU 201 of the printing apparatus 101 executing a program which has been deployed into the RAM 203.

First, in step S1101, each time the printing process is completed, the print control module 315 determines whether or not the incremented counter value (count value) for the number of sheets discharged has reached a chart insertion interval set in advance in the printing apparatus 101 via the screen of FIG. 4B. When it is determined that the print control module 315 has reached the chart insertion interval, the process in step S1102 and subsequent steps is performed. In step S1102, the print control module 315 instructs the print job generation module 301 to execute an interrupt job for inserting a chart. This instruction is accompanied by information indicating that the job is for inserting a chart and information on the sheet feeder. The print job generation module 301 generates a print job based on an instruction from the print control module 315.

In step S1103, the print job generation module 301 determines whether or not a job for inserting a chart can be executed. If a job for inserting a chart can be executed, a print job is generated; if it cannot be executed, a print job is not generated. The determination of whether or not it can be executed determines, from the type of sheet of the sheet feeder received from the print control module 315, whether or not a job uses a sheet that has a specific position in a sequence of sheets (a sheet whose position in a sequence matters), such as a tab divider. If the sheet to be printed in the job is a sheet that has a specific position in a sequence of sheets, it is determined that execution is impossible, a warning display as illustrated in, for example, FIG. 13B, is performed on the console unit 206, and the process thereafter is not executed. Meanwhile, if the sheet to be printed in the job is not a sheet that has a specific position in a sequence of sheets, the process proceeds to step S1104 as executable.

In step S1104, the print job generation module 301 registers the generated print job in the job control module 303. Then, in step S1105, the job control module 303 determines the execution order of the registered print jobs and starts processing in sequence. Then, the job control module 303 notifies the page control module 304 of the start of the processing. The information of the sheet feeder notified by the print control module 315 in step S1102 and the information that the job is for inserting a chart are added to this notification. Then, in step S1106, the job control module 303 instructs the sheet feeder management module 313 to start processing. In step S1107, when the start of processing is received from the job control module 303, the page control module 304 instructs the sheet feed control module 314 to feed the sheet feeder notified from the job control module 303. Accordingly, in step S1108, the sheet feed control module 314 feeds from the instructed sheet feeder in accordance with the feeding instruction from the page control module 304. Then, in step S1109, the sheet feed control module 314 notifies the page control module 304 of the feeding result.

When the normal feeding result is received from the sheet feed control module 314, in step S1110, the page control module 304 instructs the image generation module 307 to generate and transfer the print image data. At this time, the sheet feeder from which feeding is to be performed, the sheet size, the sheet type, and information that the print job is for inserting a chart are notified from the page control module 304 to the image generation module 307.

Accordingly, in step S1111, the image generation module 307 transfers, to the patch combination module 309, the print image data for chart insertion and information on the sheet feeder, the sheet size, and the sheet type notified from the page control module 304. Here, since only the patch image for adjustment is printed on the chart to be inserted, the print image data generated by the image generation module 307 is an image of white paper. Then, in step S1112, the patch combination module 309 combines information on marks for tone adjustment (tone patches) in the space of the print image data transferred by the image generation module 307. Then, in step S1113, the patch combination module 309 transmits, to the print control module 315, the generated combined image data and the information on the sheet feeder, the sheet size, and the sheet type notified from the image generation module and instructs printing.

Accordingly, in step S1114, the print control module 315 prints the received image data (image data with which the information on marks for tone adjustment has been combined) on the sheet fed by the sheet feed control module 314 (patch printing). When printing is completed in this way, in step S1115, the print control module 315 notifies the page control module 304 and the sensor control module 312 of completion of printing (completion of discharge). Information such as the sheet feeder, sheet size, and sheet type is added to this notification of completion of printing (completion of discharge). Then, when a print completion (discharge completion) notification is received from the print control module 315, in step S1116, the page control module 304 notifies the job control module 303 of completion of processing of one page.

Meanwhile, when the print completion (discharge completion) notification is received from the print control module 315, in step S1117, the sensor control module 312 performs colorimetry of the printed information on marks for tone adjustment (tone patches). Next, in step S1118, the sensor control module 312 notifies the reference information storage module 311 of the colorimetric result in association with information such as the sheet feeder, the sheet size, and the sheet type notified from the print control module 315. Accordingly, in step S1119, the reference information storage module 311 searches for and determines whether the reference information corresponding to the information notified from the sensor control module 312 is stored in the RAM 203. Here, when the reference information corresponding to the notified information is stored, in step S1120, the correction information is calculated from the stored reference information and the colorimetric result notified from the sensor control module 312. Then, in step S1121, the reference information storage module 311 notifies the correction information storage module 310 of the calculated correction information. Next, in step S1122, the correction information storage module 310 stores, as the correction information, the content notified from the reference information storage module 311.

Meanwhile, when the reference information is not stored in step S1119, in step S1123, the reference information storage module 311 stores the information (the colorimetric result, the sheet feeder, the sheet size, the sheet type, and the like) notified from the sensor control module 312 as the reference information in RAM 203.

Accordingly, when the completion of processing is received, in step S1124, the job control module 303 notifies the print job generation module 301 of the end of the print job.

As described above, according to the first embodiment, when a job for printing tone patches is inserted during an execution of a print job, by determining the sheet information of the sheet feeder from which feeding is performed, it becomes possible to, when the sheet is not suitable for the interrupt adjustment, not to perform the interrupt adjustment. Therefore, it is no longer necessary for the user to be aware when setting the sheet feeder or the like to be used in the print job to perform the interrupt adjustment, and it becomes possible to solve the problem that a sequence of sheets becomes different due to a sheet that has a specific position in the sequence being is consumed by an interrupt adjustment job.

Second Embodiment

In the first embodiment described above, when a print job is executed by the printing apparatus 101, it is determined whether or not to insert a chart for the interrupt adjustment. However, as described in FIG. 4B, an interval between instances of interrupt printing of automatic tone adjustment is held for each type of sheet. Therefore, with respect to those for which a chart cannot be inserted, a warning may be issued at the time of registration of an interrupt interval. This example will be described as a second embodiment. Since the configuration of the print system, the hardware configuration of the printing apparatus 101, and the like according to the second embodiment are the same as those of the first embodiment described above, description thereof will be omitted.

A setting screen displayed on the console unit 206 of the printing apparatus 101 according to the second embodiment is the same as the above-described FIG. 4B.

Figure 12:
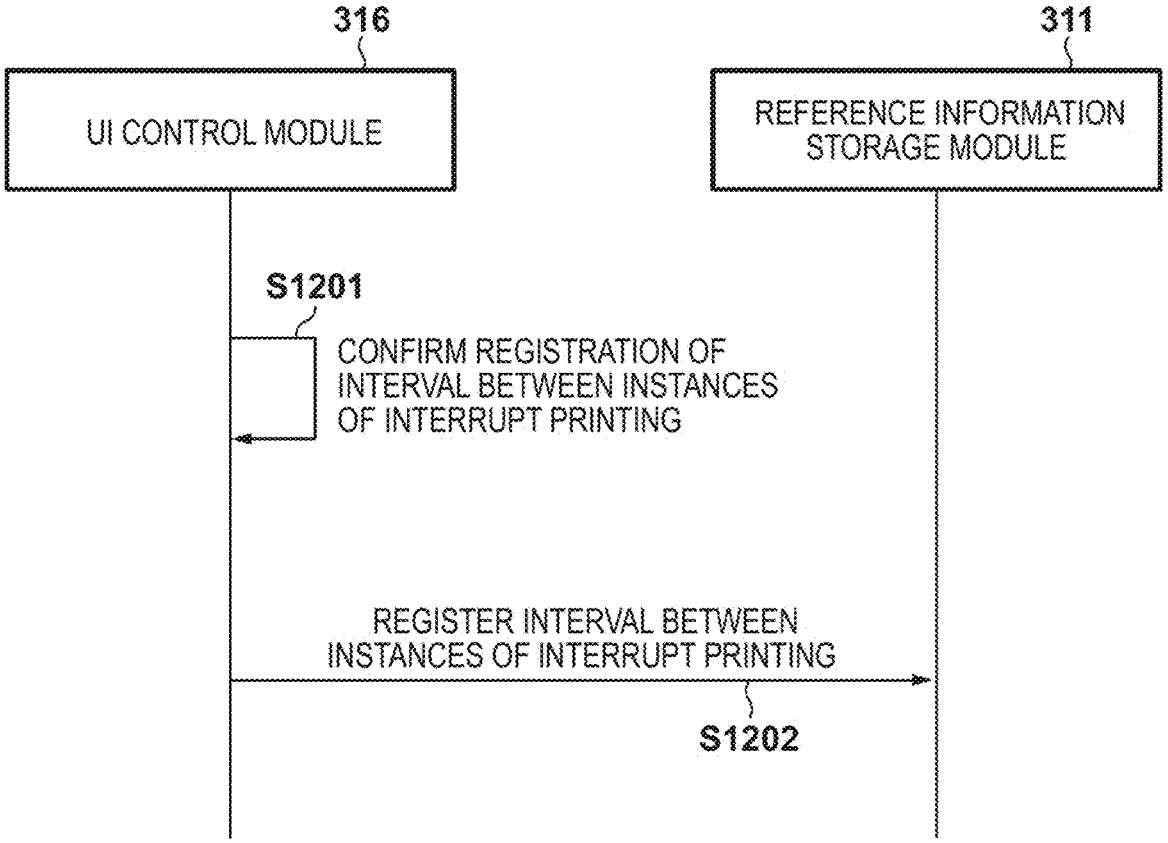
FIG. 12 is a sequence diagram for explaining a flow of processing for when registering an interval between instances of printing of a chart for an interrupt adjustment in the printing apparatus according to a second embodiment.

FIG. 12 is a sequence diagram for explaining a flow of processing for when registering an interval for printing a chart for an interrupt adjustment in the printing apparatus 101 according to the second embodiment.

When the user inputs a numerical value to the interval between instances of interrupt printing 421 and presses the OK button 423 on the screen 420 of FIG. 4B, the UI control module 316 starts confirmation of registration of the interval between instances of interrupt printing.

When it is detected that the OK button 423 has been pressed, in step S1201, the UI control module 316 confirms the interval between instances of interrupt printing designated on the screen 420. Then, if it is determined that there is no problem in the interval between instances of interrupt printing, in step S1202, the interval between instances of interrupt printing is registered to the reference information storage module 311.

Figure 13A:
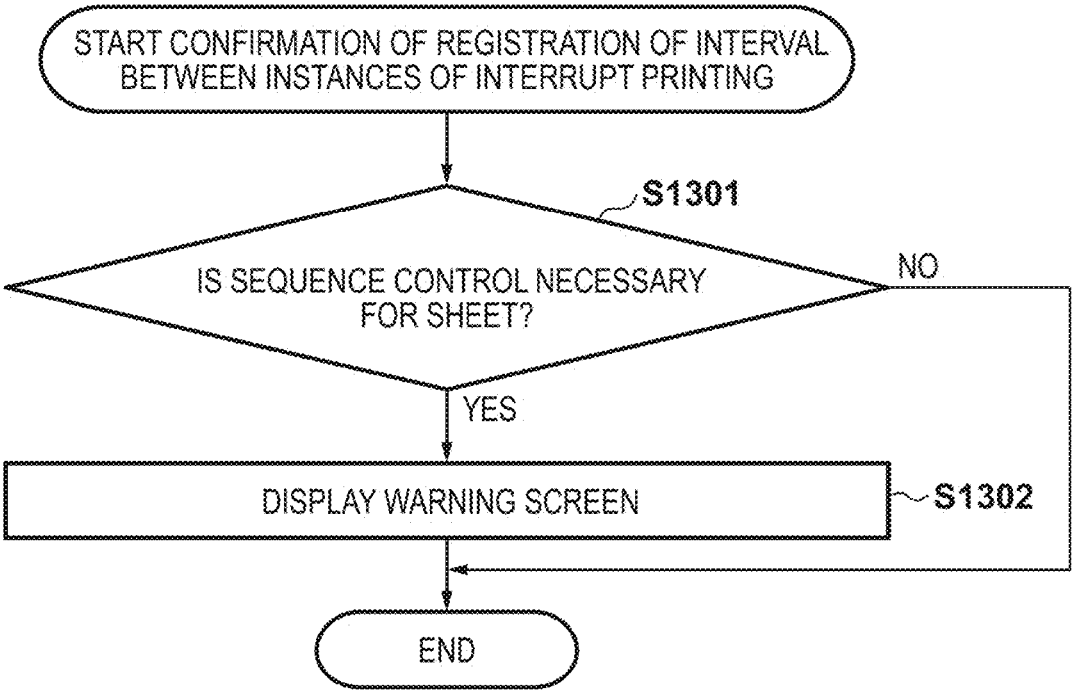
FIG. 13A is a flowchart for explaining a process of confirming the registration of an interval between instances of interrupt printing of step S1201 of FIG. 12.
Figure 13B:
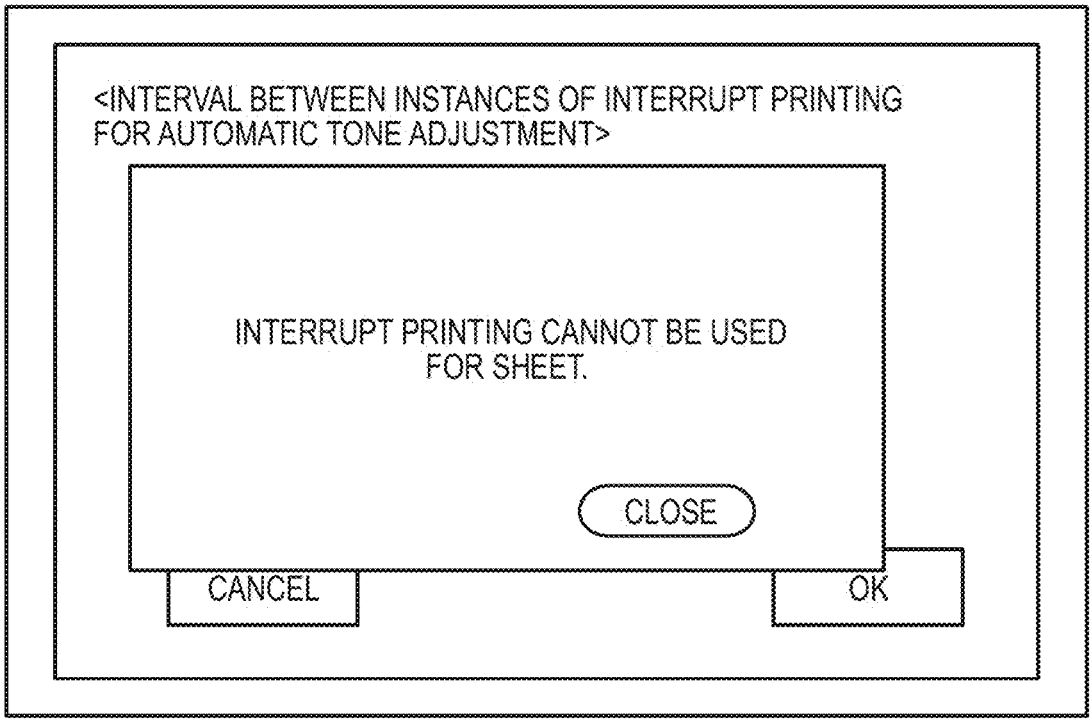
FIG. 13B depicts a view illustrating an example of a warning screen according to the second embodiment.

FIG. 13A is a flowchart for explaining a process of confirming the registration of an interval between instances of interrupt printing of step S1201 of FIG. 12.

First, in step S1301, since the information set via the screen 420 is held in the reference information storage module 311 for each type of sheet, the CPU 201 determines whether or not the type of sheet for which the interval between instances of interrupt printing is to be set has a specific position in a sequence of sheets, such as a tab divider. If the sheet has a specific position in a sequence of sheets, the CPU 201 determines that registration is impossible and the processing proceeds to step S1302 and the CPU 201 displays a warning screen as illustrated in, for example, FIG. 13B, in the console unit 206 and ends this process. Meanwhile, when it is determined in step S1301 that the sheet does not have a specific position in a sequence of sheets, the CPU 201 directly ends the process. In this case, in step S1202 of FIG. 12, the interval between instances of interrupt printing is registered to the reference information storage module 311.

As described above, according to the second embodiment, when the user sets an interval between instances of interrupt printing, it is determined whether or not the type of sheet to be a target has a specific position in a sequence of sheets, and if the type of sheet has the specific position in a sequence of sheets, it is possible not to execute interrupt printing. This makes it possible to prevent the occurrence of a problem that the sequence of the printed sheets becomes different from what was originally intended by the user due to a job for printing tone patches being inserted during an output of a print job.

Third Embodiment

In the first embodiment described above, when a print job is executed, it is determined whether or not to insert a chart for interrupt adjustment. However, as described in FIGS. 4A and 4B, the chart inserting type (in which a test page is outputted for each fixed number of sheets) is designated from the information processing apparatus 102. Therefore, with respect to those for which a chart cannot be inserted, configuration may be taken so as to control to issue a warning for an instruction from the information processing apparatus 102. Since the configuration of the print system, the hardware configuration of the printing apparatus 101, and the like according to a third embodiment are the same as those of the first embodiment described above, description thereof will be omitted.

A print setting screen of a printer driver that operates in the information processing apparatus 102 according to the third embodiment and is for a user to perform print settings for the printing apparatus 101 is the same as the screen 400 of the above-described FIG. 4A.

Figure 14A:
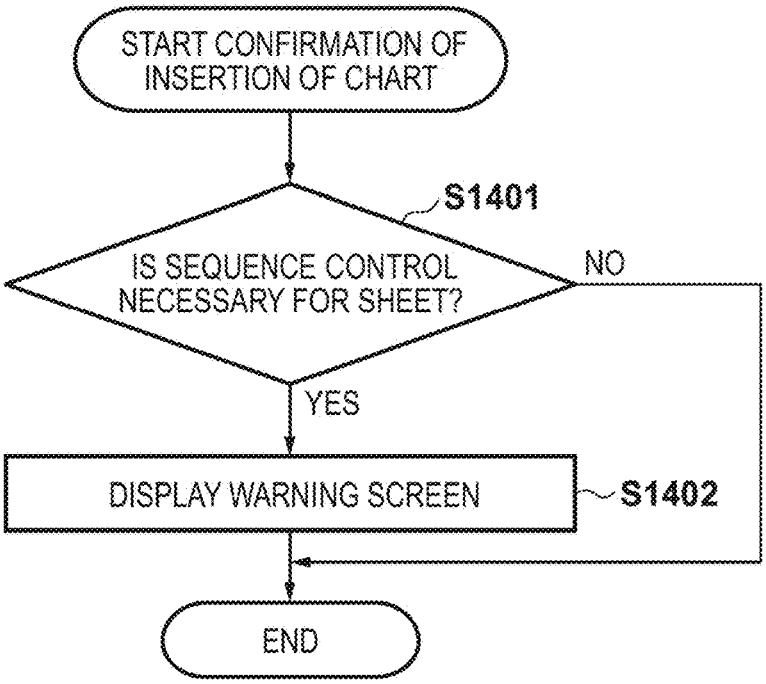
FIG. 14A is a flowchart for explaining a process of confirming an insertion of a chart by the information processing apparatus according to a third embodiment.

When the user selects the chart inserting type 410 and presses the OK button 411 on this screen 400, the process of confirming an insertion of a chart described in FIG. 14A is started FIG. 14A is a flowchart for explaining a process of confirming an insertion of a chart by the information processing apparatus 102 according to a third embodiment.

Figure 14B:
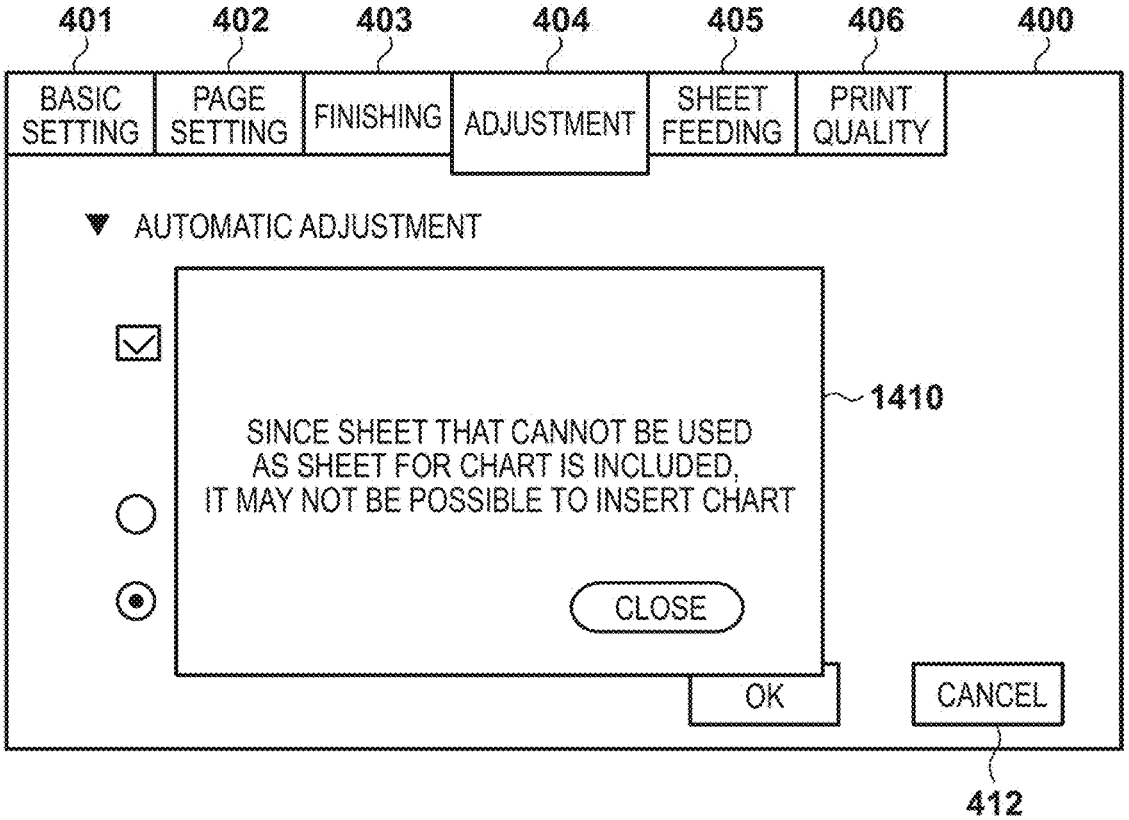
FIG. 14B depicts a view illustrating an example of a warning screen according to the third embodiment.

In step S1401, it is determined whether or not the type of sheet set in the paper feed tab 405 in FIG. 4A has a specific position in a sequence of sheets (a sheet whose position in a sequence matters), such as a tab divider. When it is determined that the sheet has the specific position in a sequence of sheets, it is determined that a chart cannot be inserted, and the process proceeds to step S1402, and a warning screen 1410 as illustrated in FIG. 14B is displayed on a display unit of the information processing apparatus 102, for example.

By performing processing as described above, it becomes possible to, when the user inputs a print job to the information processing apparatus, determine whether or not the interrupt adjustment can be executed. Thus, it is possible to obtain the same effects as in the foregoing embodiments.

Other Embodiments

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-085580, filed May 20, 2021, which is hereby incorporated by reference herein in its entirety.

What is claimed is:

1. A print system having an information processing apparatus and a printing apparatus configured to receive a print job from the information processing apparatus and execute printing, the information processing apparatus comprising:

one or more first processors that execute instructions stored in one or more first memories to cause the information processing apparatus to:

insert a chart sheet on which patches for tone correction have been printed into the print job, and the printing apparatus comprising:

a printer unit; and one or more second processors that execute instructions stored in or more second memories being configured to cause the printing apparatus to:

in a case where the print job includes a setting to insert the chart sheet, control not to insert the chart sheet in a case where a type of sheet to be used in the print job is a tab divider having a specific position in a sequence of sheets.

2. The print system according to claim 1, wherein the one or more second processors are further configured to:

in a case of inserting the chart sheet, cause the printer unit to print the patches for tone correction on the chart sheet;

perform colorimetry for the patches printed on the chart sheet;

correct image data for printing based on a result of colorimetry; and cause the printer unit to perform printing based on image data for printing that has been corrected.

3. The print system according to claim 2, wherein the one or more second processors are further configured to:

set an interval between insertions of the chart sheet;

count the number of sheets that have been printed by the printer unit; and when a value that has been counted becomes a value that corresponds to the interval that has been set, cause the printer unit to print the patches for tone correction on the chart sheet.

4. The print system according to claim 3, wherein the interval is set based on the number of sheets that have been printed.

5. A printing apparatus having a printer unit and a colorimeter, the apparatus comprising:

one or more processors that execute instructions stored in one or more memories to cause the printing apparatus to:

perform colorimetry, using the colorimeter, on a chart sheet on which patches for tone correction have been printed; and in a case where a print job includes a setting to insert the chart sheet, control not to insert the chart sheet in a case where a type of sheet to be used in the print job is a tab divider having a specific position in a sequence of sheets.

6. The printing apparatus according to claim 5, wherein the one or more processors are further configured to:

in a case of inserting the chart sheet, cause the printer unit to print the patches for tone correction on the chart sheet;

cause the colorimeter to perform colorimetry on the patches printed on the chart sheet;

correct image data for printing based on a result of colorimetry by the colorimeter; and cause the printer unit to perform printing based on image data for printing that has been corrected.

7. The printing apparatus according to claim 6, wherein the one or more processors are further configured to:

set an interval between insertions of the chart sheet;

count the number of sheets that have been printed by the printer unit; and when a value that has been counted becomes a value that corresponds to the interval that has been set, causes the printer unit to print the patches for tone correction on the chart sheet.

8. The printing apparatus according to claim 7, wherein the interval is set based on the number of sheets that have been printed.

9. A printing apparatus comprising:

a printer unit;

a colorimeter; and one or more processors that execute instructions stored in one or more memories to cause the printing apparatus to:

perform colorimetry, using the colorimeter, on a chart sheet on which patches for tone correction have been printed;

for the print job, set an interval between insertions of the chart sheet;

register the interval that has been set in association with a type of sheet; and control not to insert the chart sheet in a case where the type of sheet is a tab divider having a specific position in a sequence of sheets.

10. The printing apparatus according to claim 9, wherein the one or more processors are configured to: in the setting, set the interval based on the number of sheets that have been printed.

11. An information processing apparatus configured to input a print job to a printing apparatus to cause the printing apparatus to print the print job, the information processing apparatus comprising:

one or more processors that execute instructions stored in one or more memories to:

for the print job, set so as to print patches for tone correction; and in a case where the setting includes a setting of inserting a chart sheet on which the patches for tone correction have been printed, determine not to insert the chart sheet in a case where a type of sheet to be used in the print job is a tab divider having a specific position in a sequence of sheets.

12. A method of controlling a printing apparatus, the method comprising:

reading and performing colorimetry on a chart sheet on which patches for tone correction have been printed;

in a case where a print job includes a setting to insert the chart sheet, controlling not to insert the chart sheet in a case where a type of sheet to be used in the print job is a tab divider having a specific position in a sequence of sheets.

13. A method of controlling a printing apparatus, the method comprising:

reading and performing colorimetry on a chart sheet on which patches for tone correction have been printed;

for the print job, setting an interval between insertions of the chart sheet; and registering the interval that has been set in association with a type of sheet; and controlling not to insert the chart sheet in a case where the type of sheet is a tab divider having a specific position in a sequence of sheets.

14. A method of controlling an information processing apparatus configured to input a print job to a printing apparatus to cause the printing apparatus to print the print job, the method comprising:

for the print job, setting so as to print patches for tone correction; and in a case where the setting includes a setting of inserting a chart sheet on which the patches for tone correction have been printed, determining not to insert the chart sheet in a case where a type of sheet to be used in the print job is a tab divider having a specific position in a sequence of sheets.

15. A non-transitory computer-readable storage medium storing a program for causing a processor to execute a method of controlling a printing apparatus, the method comprising:

reading and performing colorimetry on a chart sheet on which patches for tone correction have been printed;

in a case where a print job includes a setting to insert the chart sheet, controlling not to insert the chart sheet in a case where a type of sheet to be used in the print job is a tab divider having a specific position in a sequence of sheets.

16. A non-transitory computer-readable storage medium storing a program for causing a processor to execute a method of controlling a printing apparatus, the method comprising:

reading and performing colorimetry on a chart sheet on which patches for tone correction have been printed;

for the print job, setting an interval between insertions of the chart sheet; and registering the interval that has been set in association with a type of sheet; and controlling not to insert the chart sheet in a case where the type of sheet is a tab divider having a specific position in a sequence of sheets.

17. A non-transitory computer-readable storage medium storing a program for causing a processor to execute a method of controlling an information processing apparatus configured to input a print job to a printing apparatus to cause the printing apparatus to print the print job, the method comprising:

for the print job, setting so as to print patches for tone correction; and in a case where the setting includes a setting of inserting a chart sheet on which the patches for tone correction have been printed, determining not to insert the chart sheet in a case where a type of sheet to be used in the print job is a tab divider having a specific position in a sequence of sheets.

* * * * *